United States Patent [19]

Goldsworthy et al.

[11] 4,068,357

[45] Jan. 17, 1978

[54] METHOD AND APPARATUS FOR FABRICATING OPEN WEAVE SCRIM CLOTH

[75] Inventors: William B. Goldsworthy, Palos Verdes, Calif.; Harald E. Karlson, Eugene, Oreg.

[73] Assignee: McDonnell Douglas Corporation, Long Beach, Calif.

[21] Appl. No.: 754,491

[22] Filed: Dec. 27, 1976

[51] Int. Cl.[2] ..... D04H 3/04

[52] U.S. Cl. ..... 28/101; 156/440

[58] Field of Search ..... 28/1 CL, 72 NW, 101, 28/102; 156/181, 440, 441, 177; 428/108, 109; 139/197; 242/47.12; 19/160, 163; 66/84

[56] References Cited

U.S. PATENT DOCUMENTS

| | | | |
|---|---|---|---|
| 1,358,094 | 11/1920 | Morris | 28/1 CL |
| 2,862,541 | 12/1958 | Brink | 156/440 X |
| 3,379,596 | 4/1968 | Stutz | 156/440 X |

*Primary Examiner*—Louis K. Rimrodt
*Attorney, Agent, or Firm*—Max Geldin

[57] ABSTRACT

A method and apparatus for continuously weaving fibers or filaments, particularly glass fiber filaments, into a scrim cloth, to serve as reinforcement in the fabrication of filament reinforced foam insulation slabs. The scrim cloth consisting of uniformly spaced filaments in the X (longitudinal) direction and Y (transverse) direction is fabricated by traversing the Y filaments between hooks attached to long moveable oppositely spaced side panels and by paying off bands of spaced X filaments at various locations between the Y traversing mechanism. One layer of scrim cloth is fabricated at each station, the desired number of stations for the respective layers being located sequentially along the length of the machine. In fabricating a single layer of cloth at any station, a rotatable vertical tube through which a continuous Y filament is payed from a remotely mounted spool, is moved on a cross slide mechanism transversely back and forth between the hooks on the side panels of the machine, the filament from the lower end of the tube being initially tied to the first hook. The motion of the cross slide and an arm mounted on the rotatable tube orients the Y filament on one hook or set of hooks on one side panel as the cross slide changes direction, and after traversing the distance between the side panels the cross slide and arm on the tube orients the Y filament on an oppositely facing hook or set of hooks on the opposite side panel. The X filaments for each layer are inserted as a band of spaced filaments, each such X filaments moving in the direction of longitudinal side panel travel and resting on the Y filaments.

33 Claims, 30 Drawing Figures

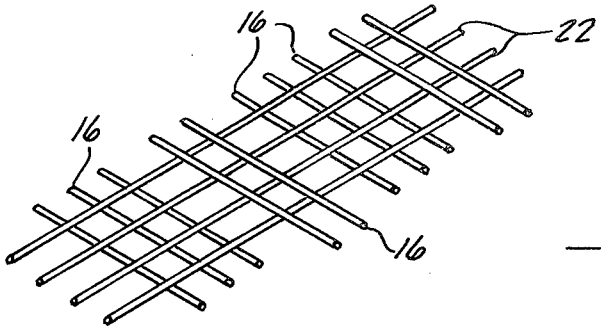
FIG. 21
FIG. 22
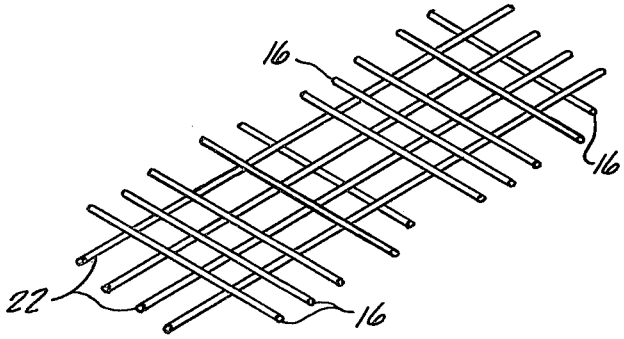
FIG. 23
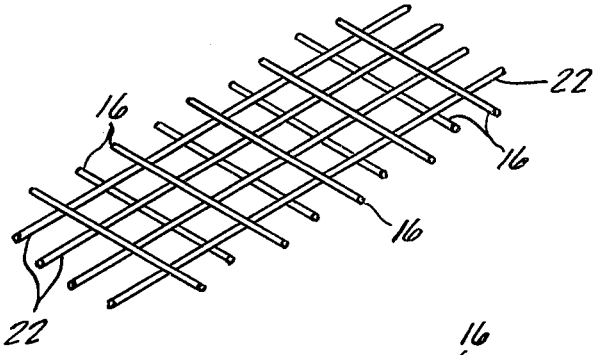
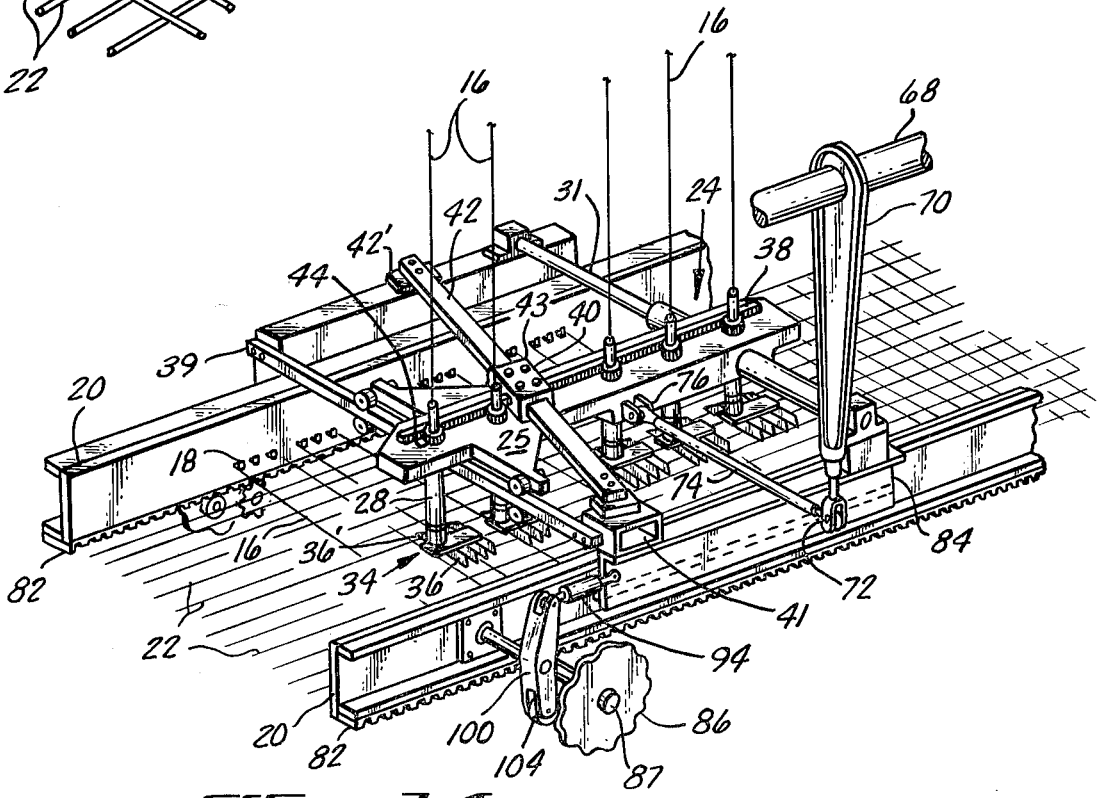
FIG. 24

METHOD AND APPARATUS FOR FABRICATING OPEN WEAVE SCRIM CLOTH

BACKGROUND OF THE INVENTION

Urethane foam which is orthogonally reinforced with filaments is an effective cryogenic insulation. One use of such insulation is in insulating compartments or holds of marine vessels used to transport liquid natural gas. Transporting natural gas in its liquid state (at cryogenic temperatures) is preferable to transporting it in its gaseous state since it is reduced in volume approximately 600 times. In one form, a metal storage tank is spaced from the hull of the vessel and insulation is applied to the inside of the tank.

The reinforcement for such foam insulation is preferably in the form of adjacent layers of X–Y fibers through which Z or vertical filaments are inserted to form an X–Y–Z orthogonal array. Urethane or equivalent foam is passed through the filamentary array and after sufficient cure, the foamed array is cut into desired length, forming planks of foam insulation which can then be bonded together to form the above noted cryogenic insulation.

The present invention is directed to the fabrication of an open weave scrim cloth formed of one or more layers of uniformly spaced fibers or filaments in the X (longitudinal) direction and Y (transverse) direction, and is particularly concerned with a novel method and apparatus for stringing the Y filaments in a transverse direction between oppositely facing hooks mounted on opposite moveable longitudinal side panels, to form a plurality of longitudinally spaced Y filaments, with means being provided for paying off the X filaments in a longitudinal direction between the Y weaving filament stations.

The presently known scrim cloth weaving mechanisms generally utilize shuttles and have pay-off mechanisms which do not allow the cloth to be mounted one layer above the other, and spaced a discrete distance apart, on hooks or tenter pins mounted on side panels, during fabrication of the cloth.

Representative of the prior art disclosing X and Y filament weaving mechanisms are the following U.S. Pat. Nos. 3,519,509; 3,607,565; 3,829,339; 3,445,319; 3,573,151; 3,878,591; 1,541,086; and 662,963. U.S. Pat. Nos. 3,345,232 and 2,812,797 are of interest in their showing of tube type elements for dispensing Y filaments between the hooks of continuously moving conveyor mechanisms.

It is an object of the present invention to provide novel procedure and mechanism for fabricating open weave scrim cloth formed of uniformly spaced X and Y fibers or filaments, particularly for use of such cloth in the production of urethane foam insulation. Another object is to provide a novel method and means for stringing the transverse Y filaments of such scrim cloth between mounting elements in the form of hooks on opposite longitudinally moving panels. A still further object is to provide means for introducing the X filaments adjacent to or between spaced Y weaving mechanisms, to permit such X filaments to rest on and be carried by the Y filaments.

SUMMARY OF THE INVENTION

In accordance with the present invention, a method and apparatus is provided for fabricating open weave scrim cloth, consisting of uniformly spaced longitudinal or X fibers or filaments, and transverse or Y fibers or filaments, particularly employing glass fiber filaments, by traversing the Y filaments between hooks attached to long moveable oppositely spaced side panels and by paying off bands of spaced X filaments at various locations between the Y traversing mechanism. One layer of scrim cloth is fabricated at each station, the desired number of stations for the respective layers being located sequentially along the length of the machine. The lowermost layer is fabricated first, using the lowermost row of hooks on the respective panels, and each subsequent layer is fabricated at a station just downstream from the previous layer, and using the next higher row of hooks on the respective side panels.

The spaced layers of scrim cloth of X–Y fibers thus continuously fabricated can then be filled with vertical Z fibers by insertion of such fibers between the spaces formed by the X and Y fibers, and the resulting 3-dimensional orthogonal array, e.g. of glass fiber filaments, can serve as a reinforcement for a foamed product, by continuously introducing the foam at a further downstream station of the machine.

Thus, the invention mechanism involves the employment of a pair of longitudinally moving parallel conveyer side panels provided on their oppositely facing surfaces with a plurality of vertically and horizontally disposed rows of hooks or tenter pins, one or several filament dispensing tube elements being arranged on a slide member for to-and-fro movement between the hooks of the respective side panels for forming one or several layers of Y filaments intermediate the side panels, and including one or several multiple X filament introducing elements positioned above the side panel conveyers and adapted to pay-off one or several multiple X filament webs longitudinally between the Y filament layers.

An important feature of the invention is the Y filament traversing or cross slide mechanism comprising a slide member to which is connected a vertical tube having mounted on its lower end an arm having fingers connected thereto for receiving a Y fiber or filament passing through the tube and fed to the fingers, which then serve to mount the Y filament on one or more hooks on opposite side panels at the respective opposite ends of travel of the Y traversing mechanism. A camming mechanism is also provided and interconnected with the payoff tube for rotation of the tube during to-and-fro movement of the Y traversing mechanism, for paying off the Y filament from the tube and proper placement thereof on the associated fingers, and to properly position such fingers in relation to the hooks on the respective side panels when the cross slide member reaches the respective opposite remote ends of its travel.

Thus, in fabricating a single layer of scrim cloth at any station, a continuous Y filament is payed from a remotely mounted spool through a vertical tube on the slide member and onto the fingers connected to the tube, and such vertical tube with the Y filament mounted thereon is moved on the cross slide mechanism back and forth between precisely placed hooks mounted on the side panels. Initially, the filament which passes from the lower end of the tube is tied to the first hook. The motion of the cross slide and the arm and associated fingers mounted on the rotating tube, as noted above, orients the Y filament on one hook or set of hooks on one side panel as the cross slide changes direction. After again traversing the distance between the side panels, the cross slide and associated arm and fingers on the tube orients the Y filament on an oppositely facing hook or set of hooks on the opposite side panel. The Y payoff tube and cross slide move in a plane perpendicular to the side panels. The X filaments for each layer are inserted as a band of spaced filaments, each such X filaments moving in the direction of longitudinal side panel travel and resting on the Y filaments.

To reduce the maximum acceleration and deceleration of the Y payoff mechanism and to permit some Y filaments to be above the X filaments, and some Y filaments to be below the X filaments in a weave-like pattern, Y filaments can be payed off from one hook or set of hooks to the opposite offset hook or set of hooks and then past a number of hooks on one panel before the return pass is made.

The timing of the Y traversing mechanism relative to the side panel movement is coordinated, since the Y traversing mechanism and the side panels are both driven through mechanical linkages and gears from the same drive. To increase the time that the Y filament arms are in close proximity to the hooks, and thereby minimize the possibility of interference during the fraction of time the filaments are snapped over the hooks on one side panel, an additional mechanism is provided when the Y traverse mechanism reaches one remote end of its travel, whereby such additional mechanism causes the Y traverse mechanism to move longitudinally for a short controlled distance at the same longitudinal speed as the side panels so that during such placement of the Y filament on the hooks of the side panel, there is no relative movement between the Y payoff mechanism and the associated fingers, and the adjacent hook or hooks. For this purpose, the Y traverse mechanism is mounted on longitudinal slides, and controlled longitudinal forward and backward movements of such mechanism are effected by a cam mechanism with a spring return.

Due to the forward or longitudinal travel of the side panels and hooks thereon down the conveyer line, the actual Y filament path is a figure 8 motion between the hooks of the respective opposite side panels. This motion is obtained by virtue of the Y filament payoff mechanism which moves transversely between the side panels and which has a rotating tube and attached arm to pick up the Y filament and snap it over the hooks at each side panel as noted above. Such tube rotation and corresponding arm rotation is achieved according to a preferred embodiment by the movement of a rack riding on a fixed diagonal cam positioned transversely to the direction of panel travel, and a pinion attached to the payoff tube and meshing with the rack. As the Y filament tube moves transversely on the Y traverse mechanism in one direction or the other, the rack is moved in the direction of panel travel, causing the tube and attached arm to rotate either clockwise or counterclockwise and to place the arm and attached fingers at the proper location adjacent one or more hooks on the respective side panels for snapping the Y filament onto such hooks, when the Y traverse mechanism has reached its respective opposite ends of traverse.

According to a further feature, means is provided for maintaining the lower end of the payoff tube and associated arm and fingers a short but sufficient distance above the previously strung Y and X filaments in order to assure proper clearance between such elements and any Y or X filaments below, and reducing the possibility of filaments catching on the Y arms and fingers, e.g. due to vibration. Such means preferably includes means such as hydraulic cylinders for tilting the fingers carrying the Y filament downwardly when the Y tube and associated fingers reach the hooks on a side panel at one end of travel of the Y traverse mechanism, such downward tilting of the fingers adjacent the hooks facilitating snapping of the Y filament over the hooks.

BRIEF DESCRIPTION OF THE DRAWINGS

FIGS. 21 to 23 illustrate variations of X—Y scrim cloth resulting from variations in the over-under pattern of the Y filaments in relation to the X filaments; and FIG. 24 is a perspective view of a Y traverse mechanism or winder assembly illustrated in FIGS. 8 to 11, carrying a total of five Y payoff tubes for simultaneously paying off five Y filaments during transverse motion of the Y traverse mechanism as illustrated in FIGS. 20 and 20A.

DETAILED DESCRIPTION OF ILLUSTRATIVE EMBODIMENT

Figure 1:
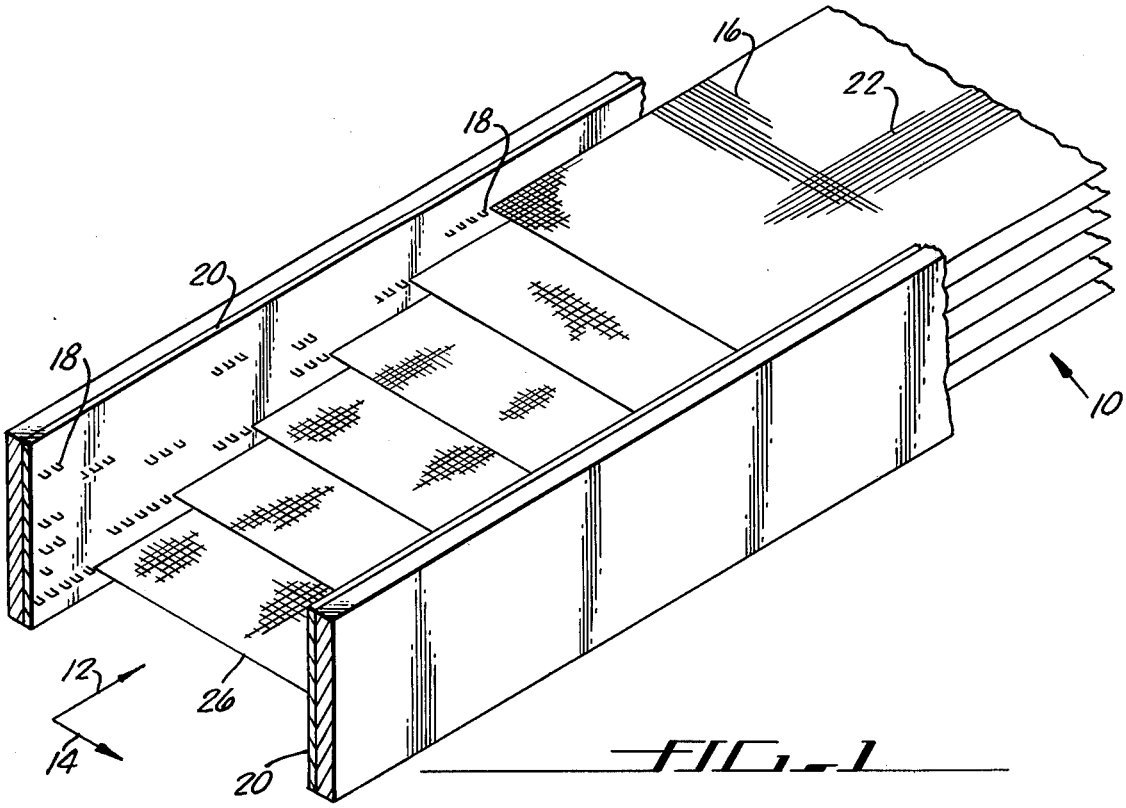
FIG. 1 is a fragmentary, partially schematic perspective illustration of the production of stacked X—Y filament layers by means of the invention apparatus.
Figure 1A:
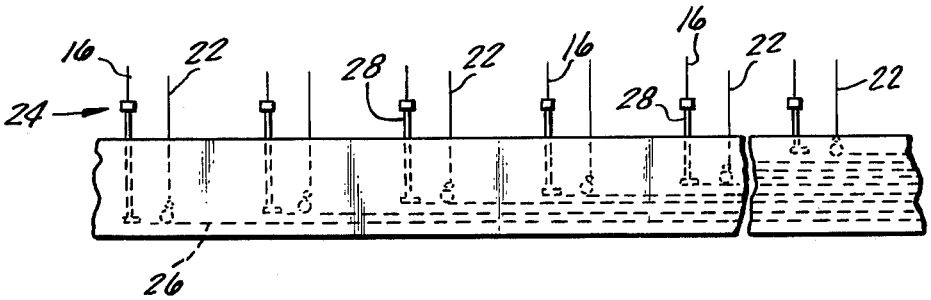
FIG. 1A is a schematic side view of the machine of the invention, schematically showing the layering of the X and Y filaments for producing the layers of scrim cloth illustrated in FIG. 1.

Referring to FIGS. 1 and 1A of the drawings, multiple layers of scrim cloth 10, consisting of uniformly spaced glass fibers or filaments in the X (longitudinal) direction, indicated at 12, and Y (transverse) direction, indicated at 14, are sequentially fabricated by traversing the Y filaments 16 between hooks indicated at 18, attached to long channel-like moving parallel side panels 20, and by paying off bands of spaced X filaments 22 longitudinally at various locations between the Y traversing mechanisms, indicated generally at 24. One layer of scrim cloth 26 may be fabricated at each station, the desired number of stations located sequentially along the length of this portion of the total machine. The bottom or lowermost layer 26 is fabricated first, using the bottom or lowermost row of hooks 18, and each subsequent layer is fabricated at a station just downstream from the previous layer, and using the next higher row of hooks 18 on the side panels 20.

The spaced layers of scrim cloth 10 thus continuously fabricated become the reinforcement for a foam which is added at a further-downstream station of the machine (not shown). However, in preferred practice, prior to addition of the foam, the X-Y layers of scrim cloth are passed to an intermediate auxiliary portion of the machine (not shown) wherein Z filaments or fibers are introduced vertically into each of the vertical column squares formed by the X-Y filaments to form a continuous X-Y-Z orthogonal array. Urethane or equivalent foam is then discharged into such X-Y-Z filamentary array and after sufficient cure, the foamed array is cut from the side panels 20 and hooks 18 into desired lengths, forming planks. A preferred method and apparatus for insertion of Z or vertical filaments into the X-Y stacked layers of scrim cloth 26, for continuously fabricating three-dimensional (3D) filament reinforced foam insulation slabs is disclosed and claimed in our copending application Ser. No. 628,802, filed Nov. 4, 1975.

Figure 2:
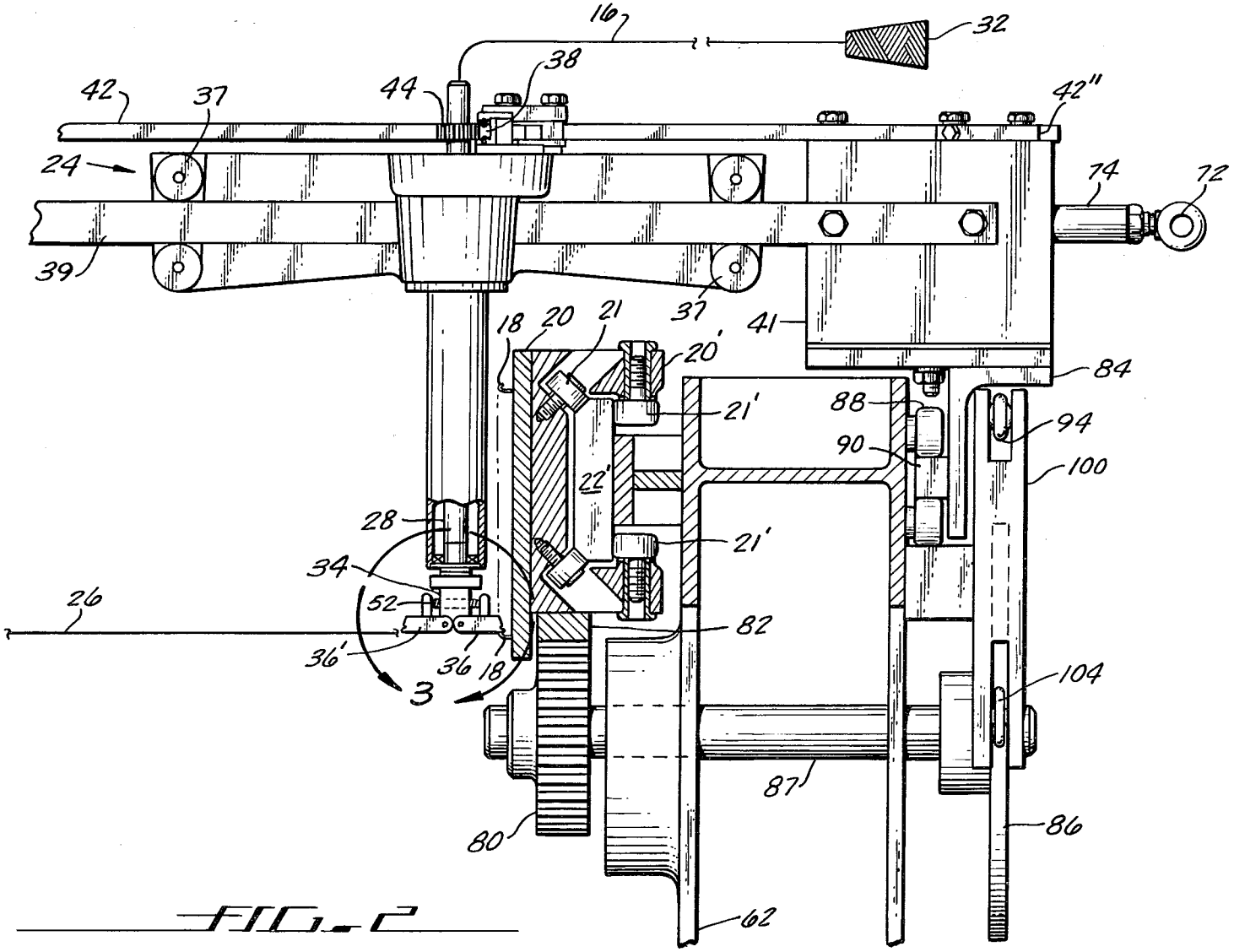
FIG. 2 is an elevational view, partly in section, showing the Y traverse mechanism at a Y filament payoff station, including the rotatable payoff tube and associated elements, and mechanism for transverse movement of the payoff tube between side panels of the machine.
Figure 3:
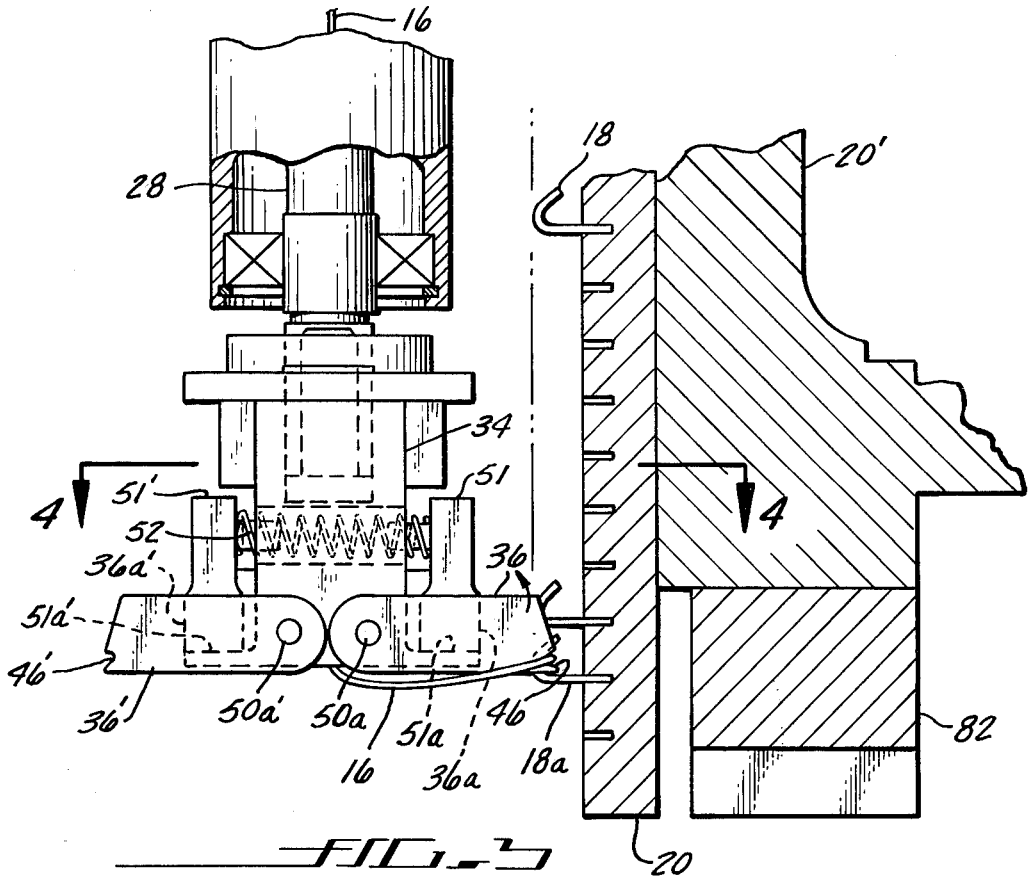
FIG. 3 is an enlarged detail of one embodiment of the pay-off tube and associated arm and fingers for grasping and supporting a Y filament and for snapping same over the hooks on one of the side panels, taken on the circular arrows 3 in FIG. 2.
Figure 4:
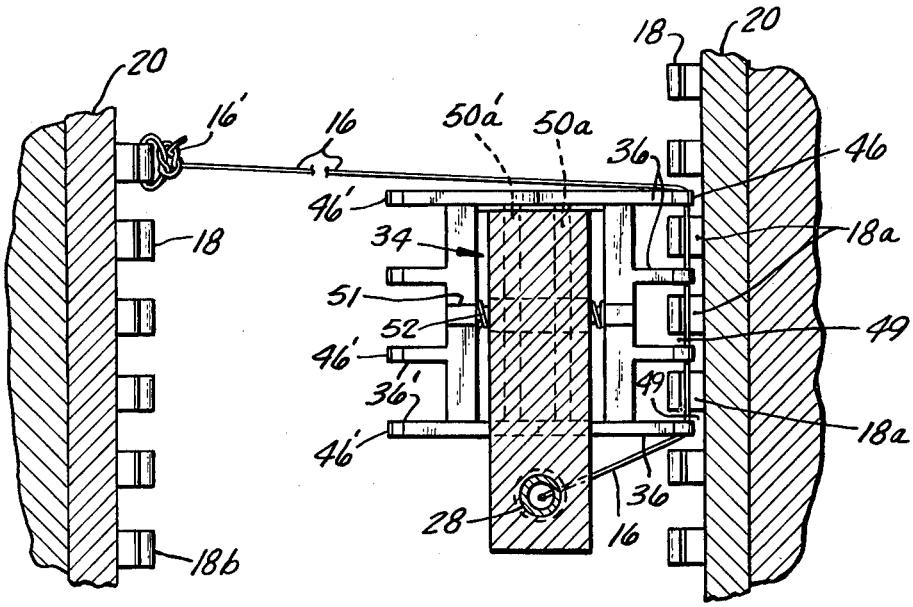
FIG. 4 is a sectional plan detail taken on line 4—4 of FIG. 3.
Figure 5:
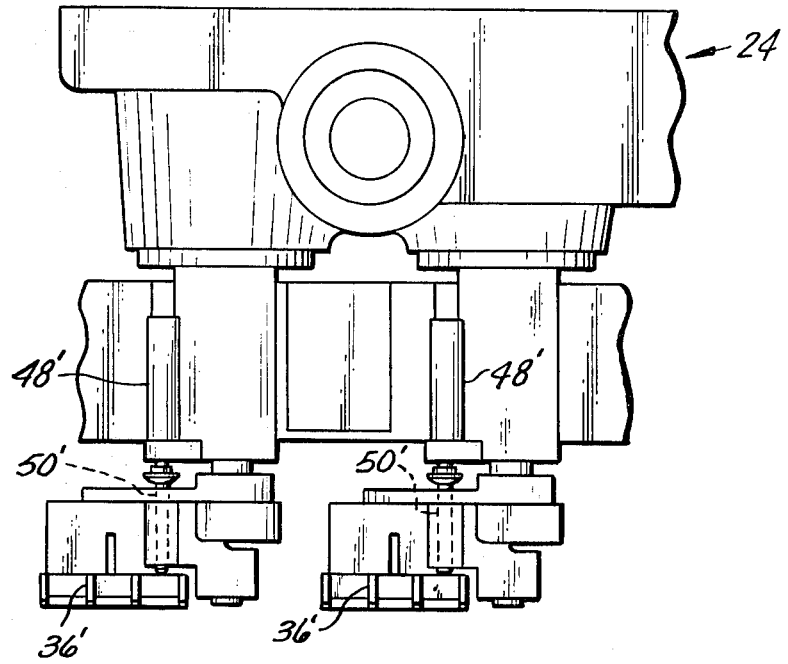
FIG. 5 is an elevational view of another preferred embodiment showing a hydraulic mechanism for tilting the fingers downward at each end of travel of the Y traverse mechanism to facilitate snapping of the Y filament onto the adjacent hooks on a side panel.

Referring now to FIG. 2 of the drawing, for fabricating a single layer of scrim cloth 26 at any station, a vertical tube 28, through which a continuous Y filament 16 is payed from a remotely mounted spool 32, is mounted on and moved on the Y traversing or cross slide mechanism 24 back and forth transversely between precisely placed opposite hooks 18 mounted on the opposite side panels 20. Referring also to FIG. 3, at the lower end of the tube 28 there is mounted an offset arm 34 extending in a horizontal plane, and having mounted thereon one set of four parallel fingers 36, and a second set of four similar parallel fingers 36', the fingers 36' being in alignment with the adjacent fingers 36, as best seen in FIG. 4.

Figure 9:
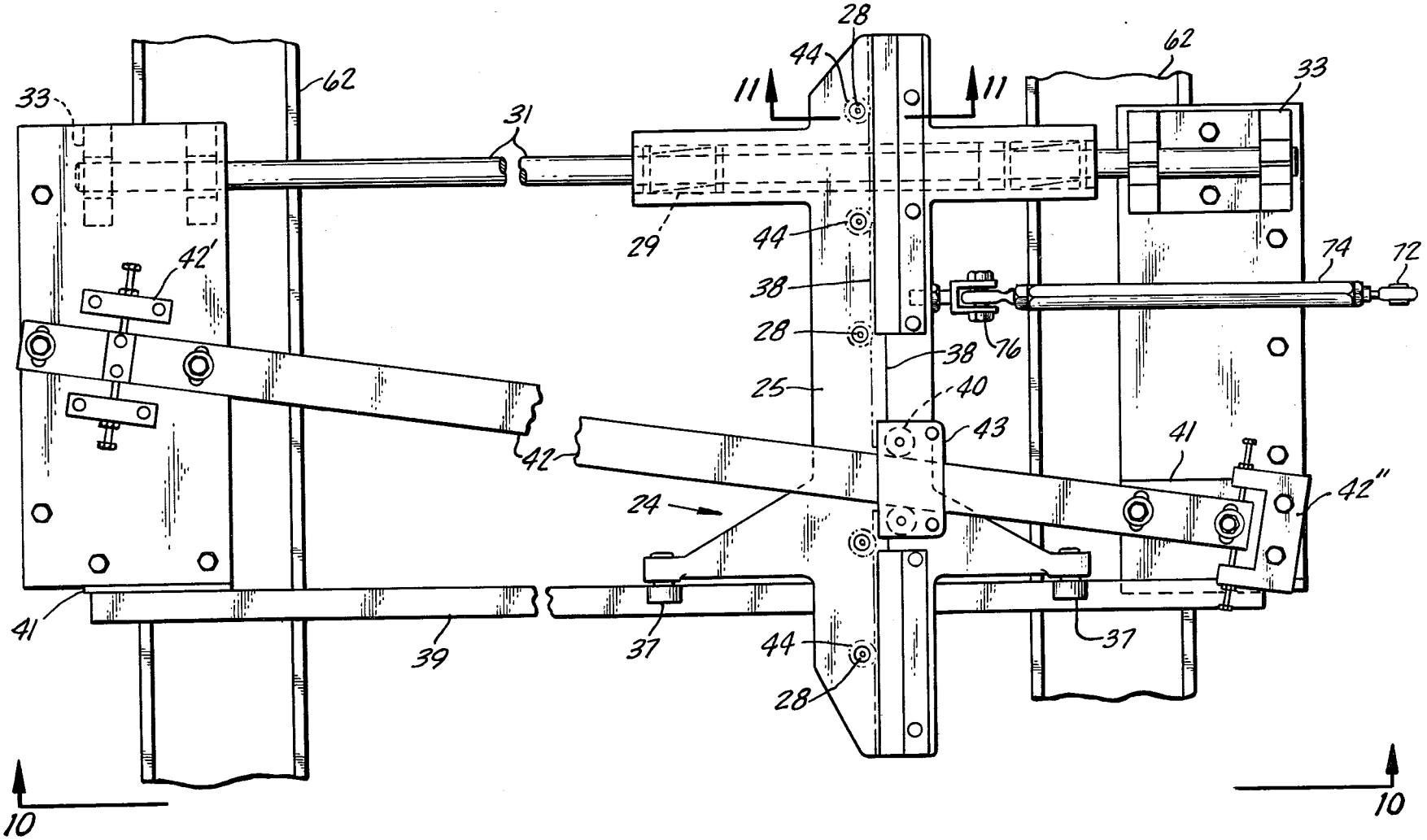
FIG. 9 is an enlarged plan view showing one of the Y traverse mechanisms of FIG. 8.

Referring to FIGS. 2, 9 and 24, it is seen that the Y traversing mechanism or cross slide 24 is comprised of a plate 25, carrying an assembly of one or more vertical payoff tubes 28, shown as five in number in FIG. 9, and associated elements. The plate 25 is mounted for transverse slideable motion at one end by means of rollers 37 on a transverse roller support or rod 39 which as best seen in FIG. 9, is mounted on suitable brackets 41 on opposite sides of the machine frame 62. The other end of plate 25 is mounted for transverse slidable motion by means of bushings 29 sliding on a transverse rod 31 mounted on brackets 33 on opposite sides of the machine frame 62.

Figure 11:
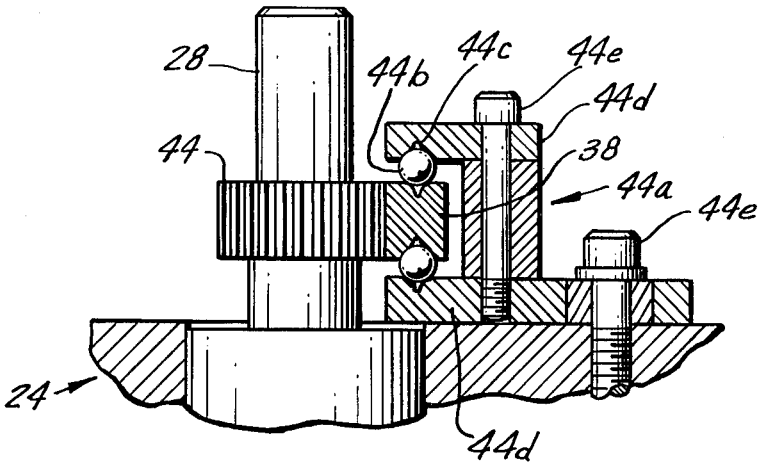
FIG. 11 is an elevational detail of the rack and pinion mechanism for rotating the Y tube, taken on line 11—11 of FIG. 9.

Referring now to FIGS. 2 and 7 to 11 of the drawing, the Y payoff tube 28 and the offset arm 34 thereon are caused to rotate by the movement of a rack 38 mounted for longitudinal movement by rollers or cam followers 40 connected to one end of the rack 38 by means of plate 43 and riding on a fixed diagonal cam 42, in a direction transverse to the direction of travel of panels 20, the rack being engaged with a pinion 44 attached to each of the payoff tubes 28. The cam 42 is mounted on brackets 42', 42'' on opposite sides of the machine, and is positioned at a predetermined angle with respect to the transverse rod 39. As best seen in FIG. 11, rack 38 is maintained in position on the cross slide 24 in engagement with the pinion 44 and mounted for longitudinal motion on cross slide 24, by means of a U-shaped bracket 44*a* and ball bearings 44*b* riding in grooves 44*c* formed in the opposite sides 44*d* of bracket 44*a*, bracket 44*a* being connected to cross slide 24 by means of bolts 44*e*.

Figure 7:
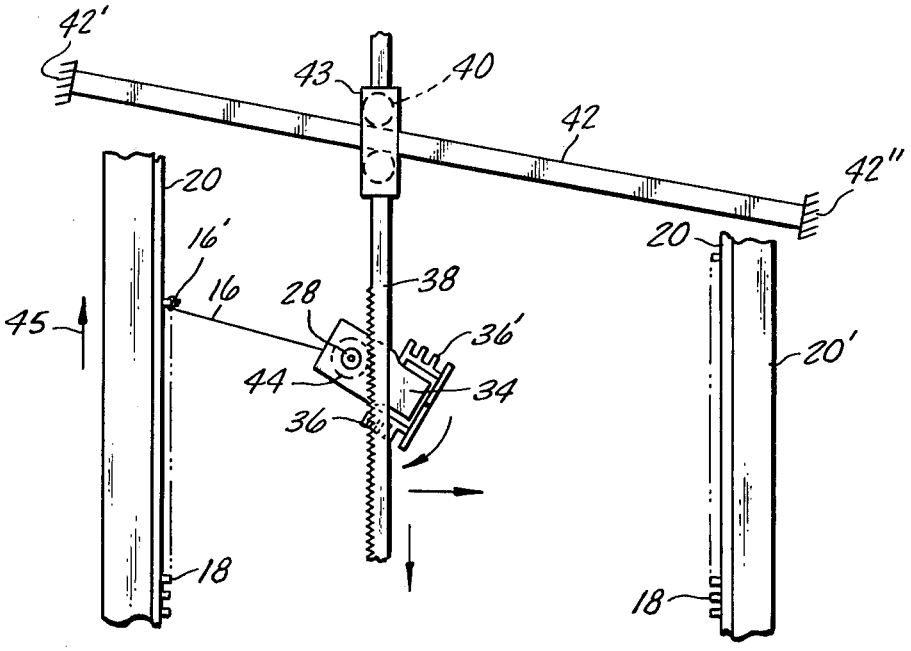
FIG. 7 is an essentially schematic plan view showing the fixed cam and associated rack and pinion mechanism for producing rotation of the payoff tube and associated arm and fingers during transverse movement of the payoff tube in one direction between the machine side panels.
Figure 7A:
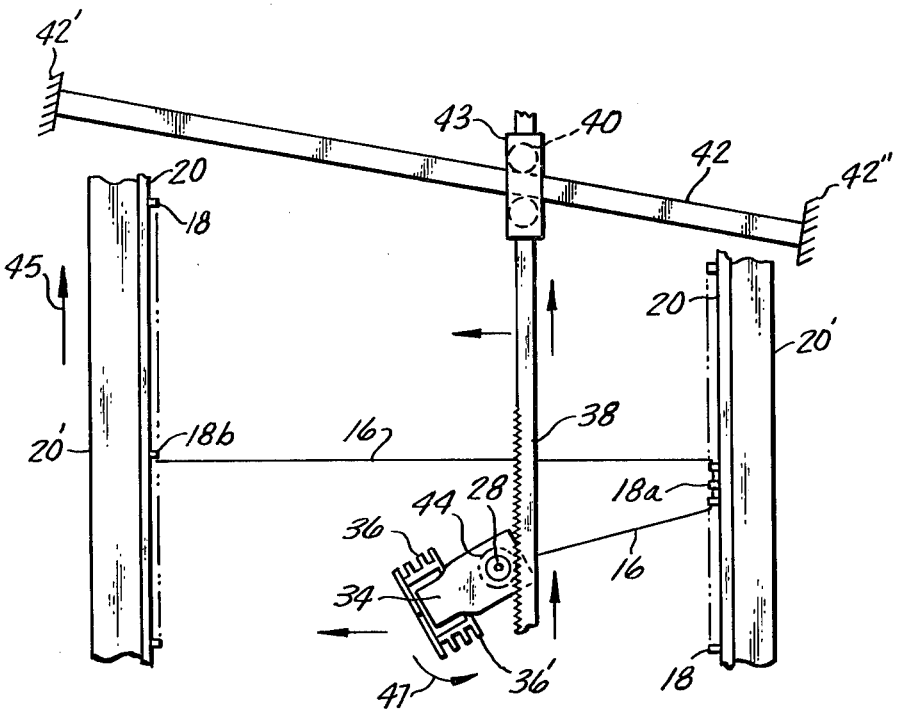
FIG. 7A is a view similar to FIG. 7, showing the payoff tube and associated arm and fingers during transverse motion of the payoff tube in the opposite direction.

Viewing FIGS. 7A and 9, as the Y payoff tube 28 mounted on the transverse cross slide 24 is moved to the left, the cam 42 causes the rollers 40, plate 43 and the rack 38 to move in the direction of panel travel indicated by the arrow 45, which causes the pinion 44 and offset arm 34 attached to the tube 28, to move counterclockwise, as indicated by arrow 47. When the Y payoff tube 28 is moved transversely to the right by the transverse slide 24, as seen in FIG. 7, the cam 42 causes the rack 38 to move in the opposite direction of panel travel, causing the pinion gear 44 and attached offset arm 34 to rotate clockwise, until the transverse slide reaches its limit of travel to the right, adjacent the right panel 20.

The adjustment of the angle of the cam 42 relative to the transverse axis corresponding to the rod 39 determines how far the rack will move longitudinally during its transverse path of travel from one side panel 20 to the opposite side panel 20 of the machine, and the degree of such longitudinal motion of the rack will govern the degree of rotation of the pinion 44 and the offset arm 34 mounted on tube 28, during the transverse travel of the tube from one side panel 20 to the opposite side panel. In the preferred embodiment, the angle of the cam 42 relative to such transverse axis is adjusted so that the pinion 44, payoff tube 28 and the offset arm 34 thereon will rotate one full revolution of 360° during the travel of the tube 28 and slide member 24 from one side panel 20 and the hooks 18 thereon, to the opposite side panel and hooks thereon. The transverse cross slide mechanism 24 which moves the payoff tube 28 in a to-and-fro transverse direction is actuated by an adjustable linkage mechanism described more fully below, and shown at 54 in FIGS. 12 and 13.

Figure 15:
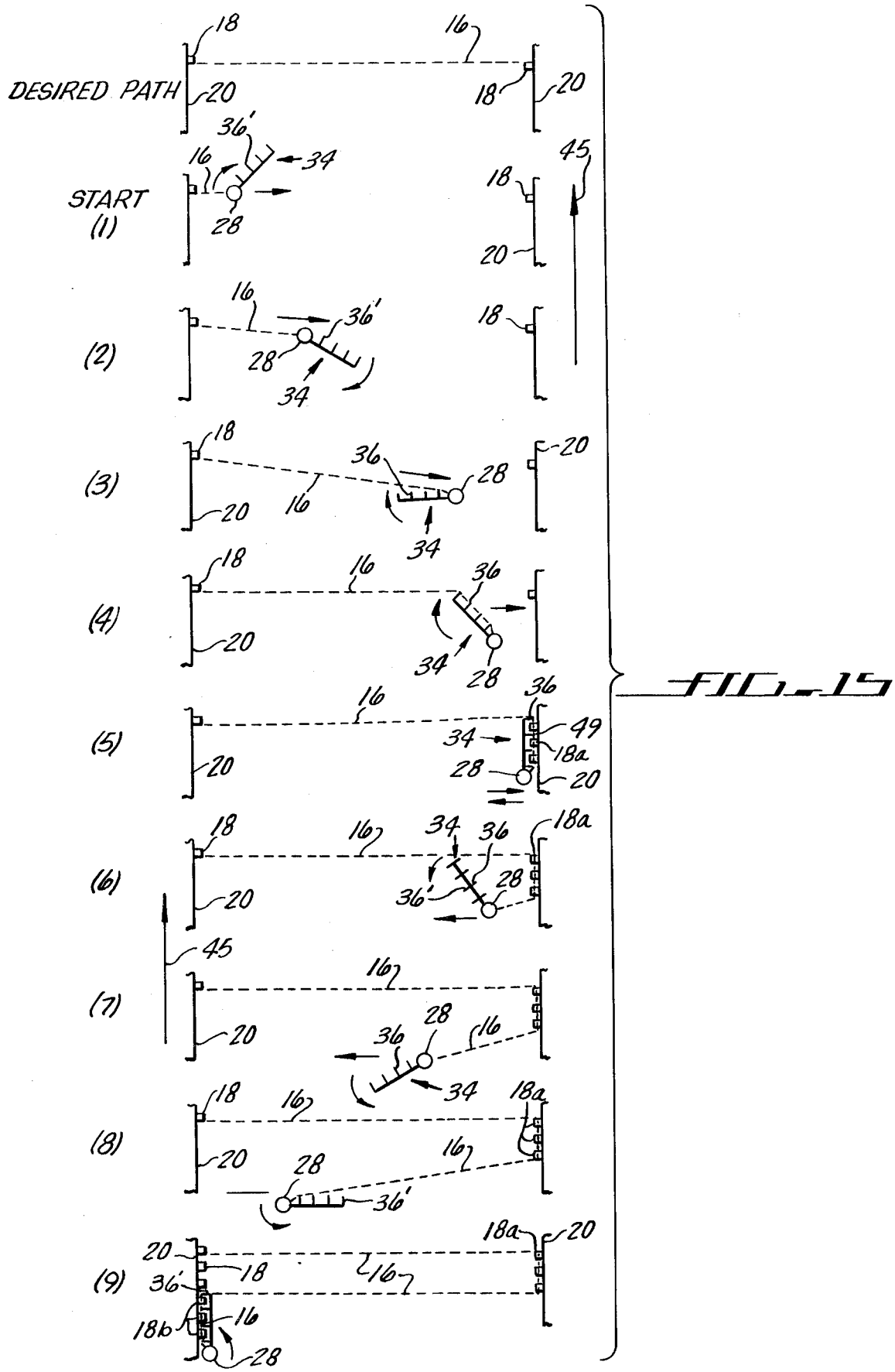
FIG. 15 is a plan view schematically and sequentially illustrating the Y filament path as it is strung transversely on the hooks of the respective side panels.

At the start of paying off a Y filament, the Y filament 16 is passed from the spool 32 (FIG. 2) through the vertical payoff tube 28 and from beneath the payoff tube 28, and is tied at 16' to a first hook 18 on a side panel 20, as shown in FIGS. 4 and 15. The linear transverse motion of the cross slide 24, and the rotational movement of the offset arm 34 mounted on tube 28, and the corresponding rotation of fingers 36 and 36' on such arm, during such transverse motion, serve to orient the Y filament 16 adjacent to and in alignment with the oppositely facing hooks on the opposite side panels 20, as seen in FIGS. 3 and 4, as the tube 28 moves back and forth transversely on the transverse cross slide mechanism 24 sliding on the transverse rods 31 and 39, as described in greater detail below.

In this respect, referring to FIGS. 3, 4 and 7, it is seen that as the offset arm 34 on tube 28 is caused to rotate in a clockwise direction, as the tube moves transversely to the right, the Y filament 16 exiting from the lower end of tube 28 is picked up by the notches 46 provided in the lower ends of all four fingers 36. For this purpose, the notches 46 are positioned just below the lower end of the tube 28. The Y filament 16 is picked up by each of the fingers 36 in succession as the tube and offset arm 34 rotate clockwise during transverse motion of tube 28, viewing FIG. 7, so that when the tube and arm 34 have rotated clockwise a full 360° in travelling transversely from the left panel 20 to the right panel 20, the fingers 36 are positioned adjacent three of the hooks 18, indicated specifically as 18*a*, on the right hand panel 20 as seen in FIG. 4.

The clockwise rotation of tube 28 and the offset arm 34 thereon during transverse movement of the tube 28 from the left-hand side panel 20 to the righthand side panel 20 until the tube 28 and the arm 34 and fingers 36 are adjacent the righthand panel 20 as seen in FIGS. 3 and 4, is schematically illustrated in steps (1) through (5) in FIG. 15. It will be seen that during such transverse motion of the tube 28, the side panels 20 are moving forward in a longitudinal direction as shown by the arrow 45.

Referring to FIG. 3, fingers 36 are mounted together on a bar 36*a* which in turn is mounted for pivotal movement on a horizontal pin 50*a* passing through offset arm 34, and fingers 36' are similarly mounted on a bar 36*a'* which in turn is mounted for pivotal movement on a horizontal pin 50*a'* passing through offset arm 34. The two sets of fingers 36 and 36' are maintained in a normal horizontal position on tabs 51*a* and 51*a'*, respectively mounted on the offset arm 34. The stops or tabs 51*a* and 51*a'* prevent downward pivotal movement of the fingers, but the fingers can be pivoted upwardly against a compression spring 52 connected at opposite ends to a pair of upstanding lugs 51 and 51' mounted on bars 36*a* and 36*a'* respectively. When the filament 16 carried in the notches 46 of the fingers 36 makes contact with and passes over the ends of the hooks 18, viewing FIG. 3, the fingers 36 pivot upwardly, as indicated by the arrow, against the action of the spring 52, and the filament is snapped over and past the upper ends of the hooks. When the filament passes beyond the upper ends of the hooks, fingers 36 are pivoted back to their normal horizontal position against stops 51*a* and 51*a'*, as seen in FIG. 3. In this position the fingers 36 are disposed in the spaces 49 between the adjacent hooks, and the Y filament is captured under the hooks as seen in FIGS. 3 and 4. At this point, viewing particularly FIG. 4, it will be noted that the Y filament 16 which is strung from one extreme finger 36 of the set of fingers 36, to the opposite finger 36, is in longitudinal alignment with the side panel 20 and the hooks 18*a*.

Figure 6:
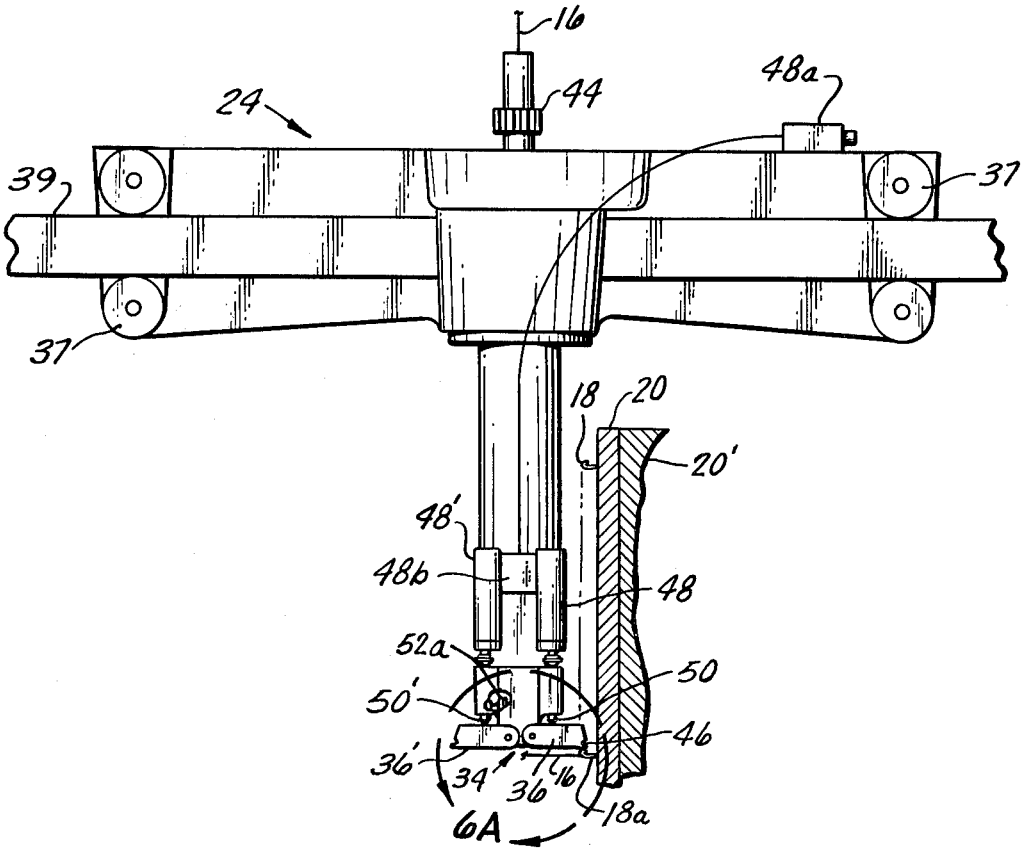
FIG. 6 is an elevational detail of the mechanism of FIG. 5, showing the means for tilting the fingers by such hydraulic mechanism and including spring means for retracting the fingers to their normal position.
Figure 6A:
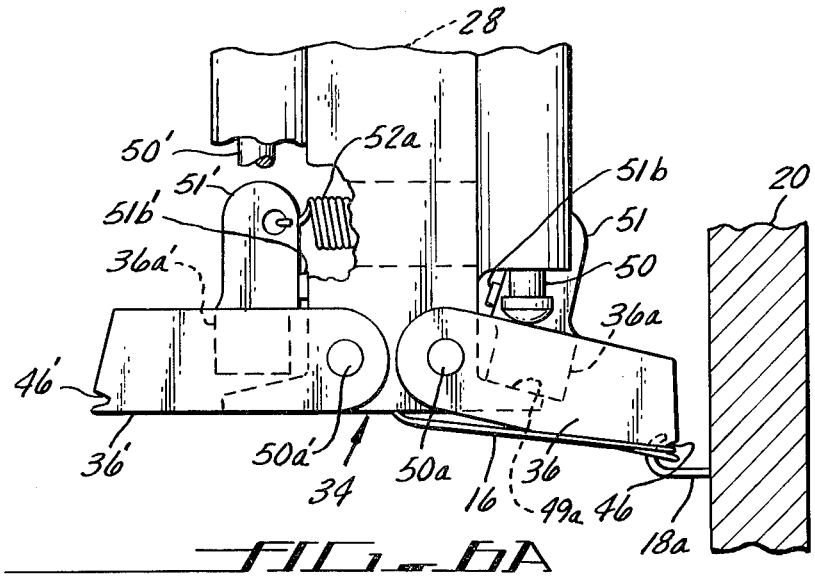
FIG. 6A is an elevational detail taken on the circular arrows 6A in FIG. 6, showing an enlarged elevational of one set of fingers in a downwardly tilted position and snapping a Y filament onto a hook on a side panel.

In another preferred embodiment including a hydraulic mechanism for pivoting the fingers 36 and 36' viewing FIGS. 5, 6, 6A and 6B, a structure similar to that shown in FIGS. 3 and 4 is provided, except that a tension spring 52*a* is employed in place of the compression spring 52, and stops 51*b* and 51*b'* are provided on lugs 51 and 51' to prevent upward pivotal motion of fingers 36 and 36' by the action of spring 52*a*. It will be noted in FIG. 6A, that in this embodiment offset arm 34 and fingers 36 and 36' are mounted somewhat higher with respect to hooks 18, than in the embodiment of FIGS. 3 and 4. Thus, when the fingers 36 are in the position shown in FIG. 6A and adjacent the hooks 18*a*, a hydraulic piston 48 mounted on the slide member 24 is actuated by suitable means such as a micro switch 48*a* and solenoid valve 48*b* mounted on slide 24 causing the lower end of rod 50 connected to pisotn 48 to make contact with the bar 36*a* and to pivot the fingers 36 downwardly, as seen in FIG. 6A, a controlled amount until the lower end of lug 51 makes contact with the upper surface of the offset arm 34, as indicated at 49*a*. This downward pivotal motion of fingers 36 places the Y filament 16 in captured position under the hooks, as indicated in FIG. 6A. At this point, the Y filament is held in position around three of the hooks indicated as 18*a* in FIG. 6B and FIG. 16.

Figure 6B:
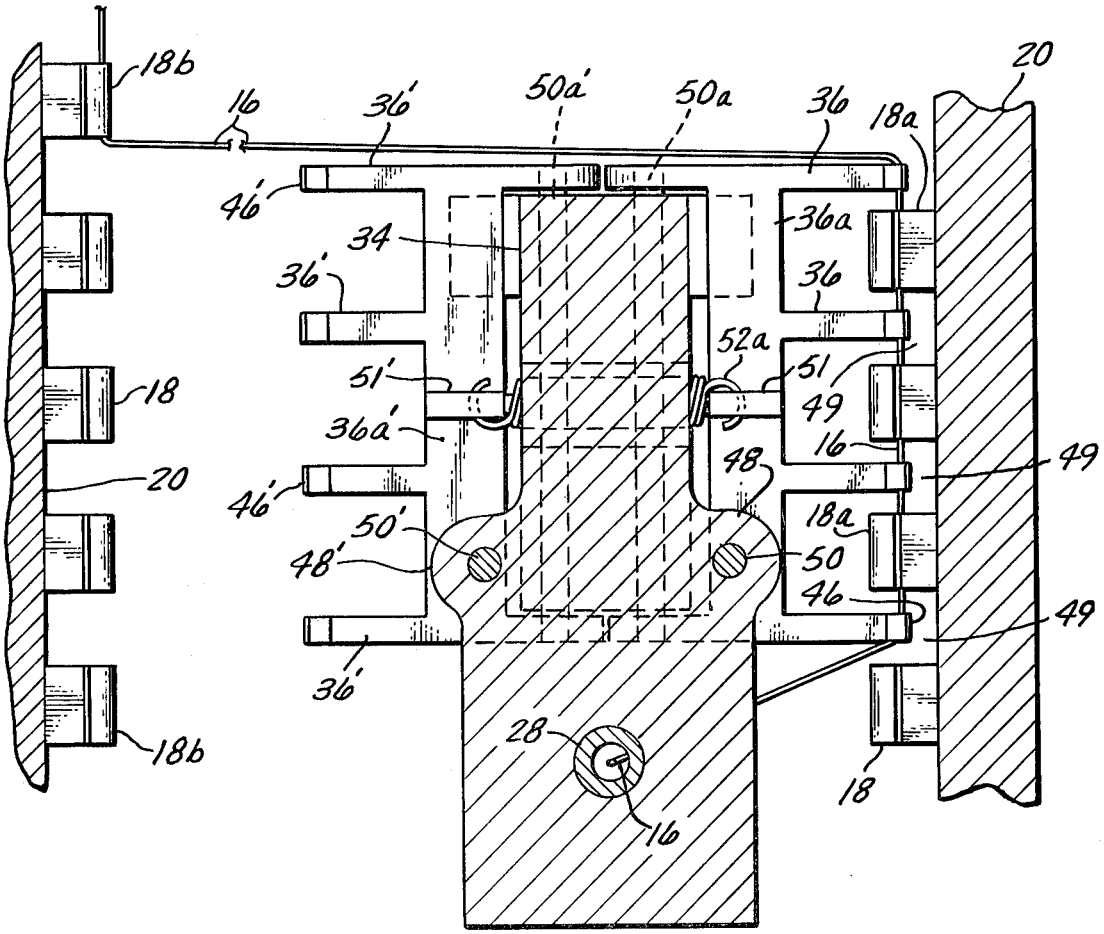
FIG. 6B is a plan view of the mechanism shown in FIG. 6A.

After the fingers 36 have snapped the Y filament onto the hooks 18*a*, as illustrated in FIGS. 6A and 6B, the cross slide mechanism 24 and the tube 28 are at location (5) in FIG. 15.

Viewing FIGS. 4, 6B and 15, as the slide member 24 carrying tube 28 and offset arm 34 now commences to move transversely to the left and away from the right-hand panel 20, the fingers 36 on offset arm 34 are retracted to the left, out of the spaces 49 between adjacent hooks 18 or 18a. Just at the commencement of such movement, with respect to the embodiment of FIG. 6A, the piston 48 actuates to release rod 50 upwardly and out of contact with bar 36a, causing the fingers 36 to move upwardly to their normal horizontal position shown in FIGS. 3 and 6, by the action of spring 52a. This places the fingers in their normal horizontal position and assures that the tube 28, offset arm 34 and fingers 36 are positioned above any previously strung Y filaments or X filaments extending below the tube and fingers.

It is thus seen in FIG. 6 that the fingers 36 in their normal horizontal position and the associated offset arm 34 are located sufficiently above the filament 16 strung on the hooks 18, to assure proper clearance and reducing the chance of Y or X filaments being caught on arm 34 or fingers 36 during traverse of these elements between side panels 20.

Figure 14:
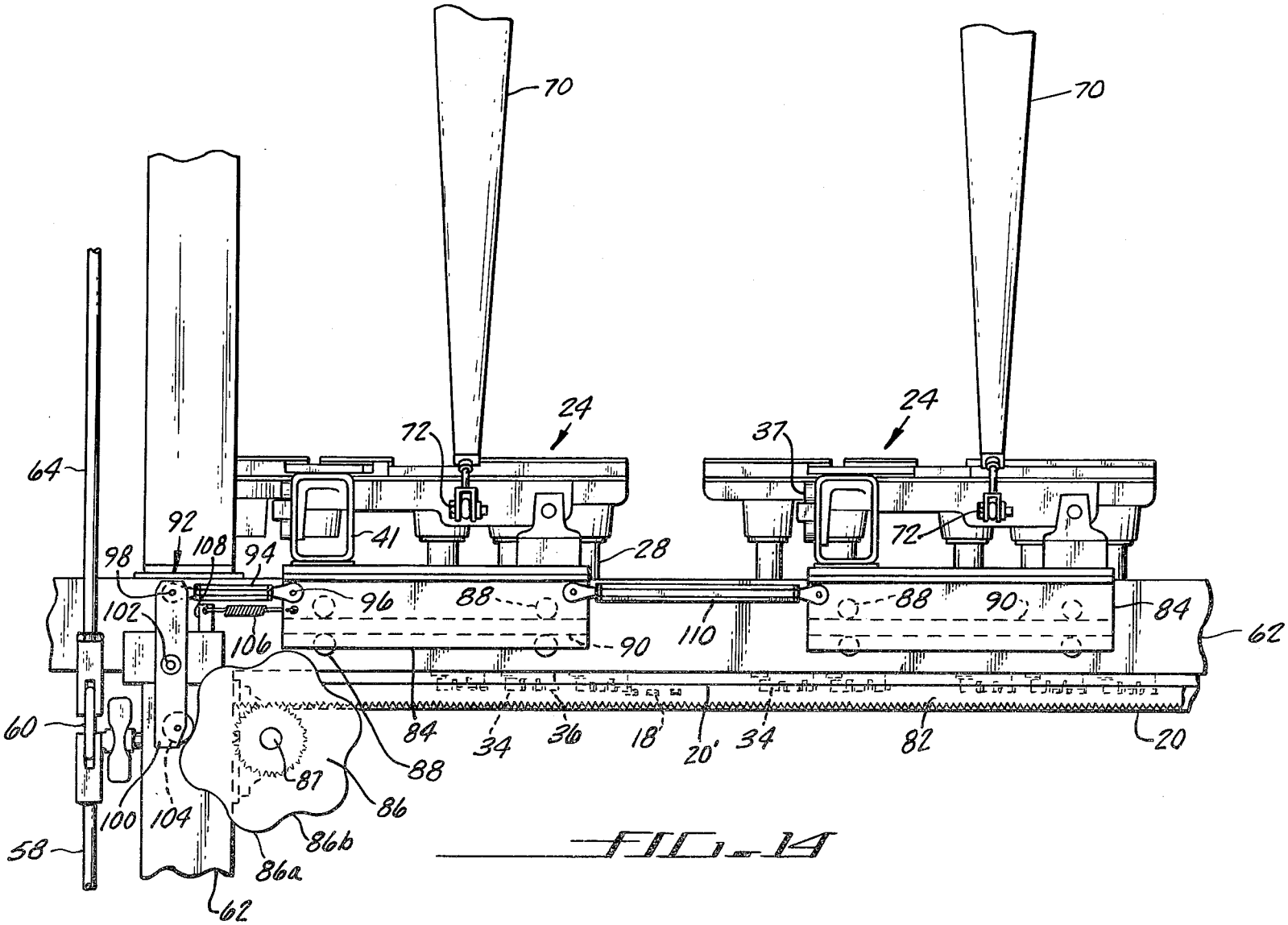
FIG. 14 is an enlarged detail side view taken on line 14—14 of FIG. 12, showing the mechanism for permitting controlled longitudinal movement of the Y payoff mechanism at the same rate of longitudinal movement as the side panels of the machine, during transfer of a Y payoff filament from the Y payoff tube and the positioning of such Y filament on the hooks of a side panel.

During the short period of time that the fingers 36 are in the position shown in FIG. 4 and at step (5) in FIG. 15, the Y slide mechanism 24 carrying the tube 28 and offset arm 34 are moved longitudinally at the same velocity and in the same direction as the side panels 20. The cam actuated mechanism for permitting such minor controlled longitudinal motion of the Y payoff tube 28 and its associated elements during the period of snapping the Y filament over the hooks 18a and into position thereon, as illustrated in FIG. 4 and step (5) in FIG. 15, is best shown in FIG. 14 and described in greater detail hereinafter. Such controlled longitudinal motion of the Y tube 28 and associated offset arm 34 and fingers 36 permit continuous longitudinal motion of the side panels 20 during attachment of the payoff fiber 16 onto the hooks without causing any binding or jamming of the fingers 36 between the hooks 18 or 18a during the fiber "snap on" action.

In preferred practice, there is provided means, as described above and shown in FIGS. 3 and 6, to pivot the fingers 36 when the payoff tube 28 reaches the position shown in FIGS. 3 and 6, and when the fingers 36 are adjacent the hooks 18. However, where the hooks are small or the Y filament is very strong, if desired, such finger pivoting means can be omitted, and the notches 46 in fingers 36 can be located at a height just below the upper ends of hooks 18a, such that the Y filament will snap over the upper ends of hooks 18a as the fingers move into the spaces 49 between the hooks, and when the fingers are retracted to the left, the Y filament is captured under the hooks, as indicated in FIG. 6A.

Figure 10:
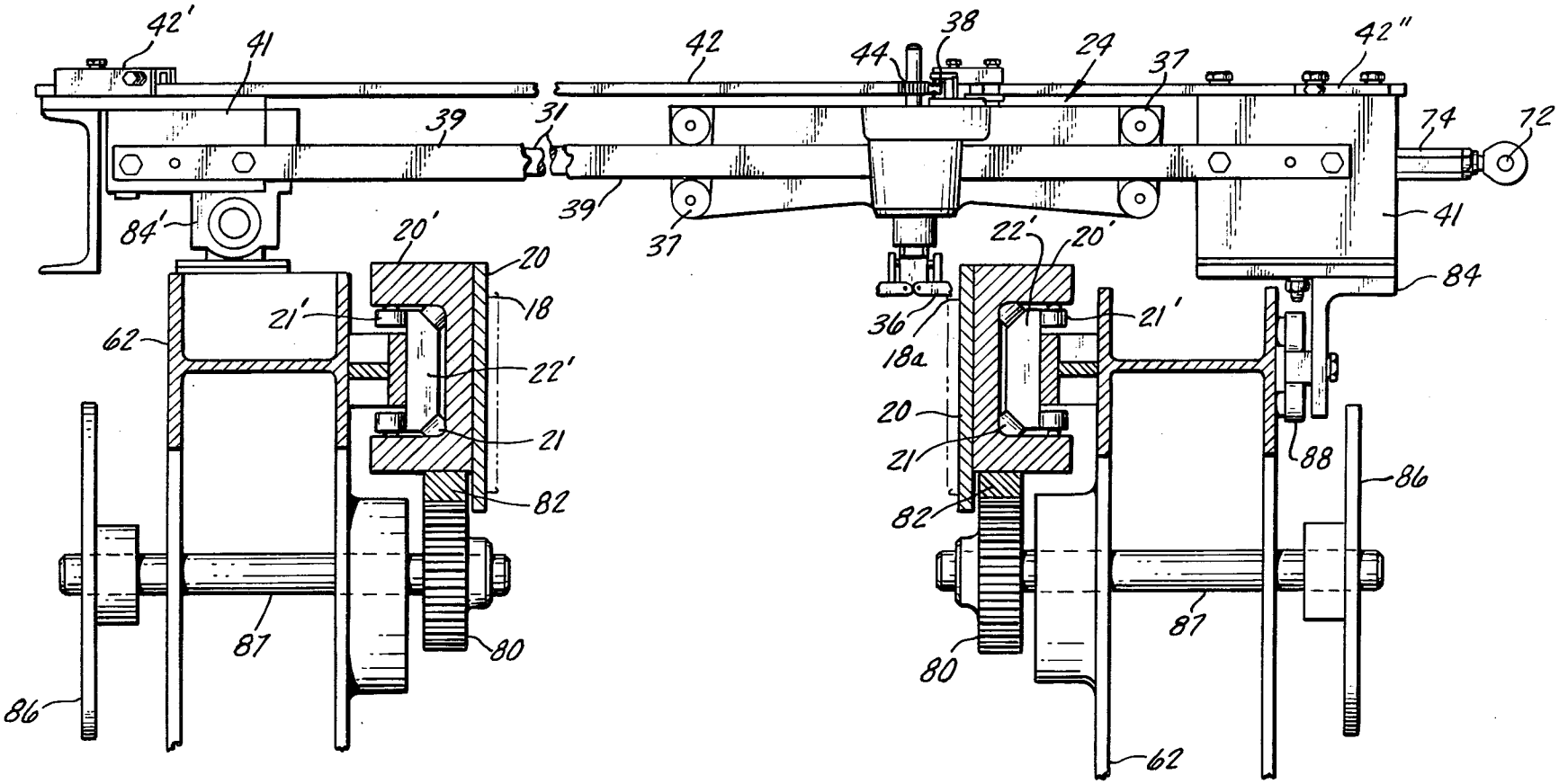
FIG. 10 is an end elevational view of the machine shown partly in section, taken on line 10—10 of FIG. 9.

Viewing FIGS. 4, 7A and 10, and step (6) in FIG. 15, as the cross slide 24 carrying the vertical Y payoff tube 28 and associated rack 38 moves to the left toward the left side panel 20, the longitudinal forward motion of the rack 38 causes counterclockwise motion of the pinion 44 and payoff tube 28, and counterclockwise motion of the associated offset arm 34 and the fingers thereon. This causes the opposite set of fingers 36', as shown in FIG. 4, to pick up the Y filament 16 in the notches 46' thereof, and when the tube 28 has traversed the entire distance from the righthand side panel 20 to the lefthand side panel 20, viewing FIGS. 7A and 10, and steps (6) to (9) of FIG. 15, the tube 28 and offset arm 34 will have rotated counterclockwise a full 360° from the position shown in FIG. 4, thus capturing the Y filament 16 in the notches 46' of all four fingers 36' and placing fingers 36' adjacent to the hooks 18, and specifically the three consecutive hooks 18b (see FIG. 15) on the lefthand panel, in a position similar to the position of fingers 36 adjacent three consecutive hooks 18a of the righthand panel 20, as viewed in FIG. 4. At this point, the filament 16 is snapped over the upper ends of hooks 18b by upward pivotal motion of fingers 36' against the action of spring 52, similar to the snapping of the filament over hooks 18a on the righthand panel 20.

In the embodiment of FIGS. 6A and 6B, when the fingers 36' are adjacent hooks 18b, a second hydraulic piston 48', located on the cross slide 24, similar to piston 48, is actuated to cause a rod 50' similar to rod 50, to contact bar 36a' and to pivot the fingers 36' downwardly, as in the case of fingers 36, against the action of spring 52a, to place the Y filament in captured position under the three hooks 18b, in a manner similar to that shown in FIG. 6A. Thereafter, the piston 48' is then actuated to retract its associated rod upwardly out of contact with bar 36a' to permit fingers 36' again to assume their normal horizontal position as shown in FIGS. 3 and 6, by the action of spring 52a. The fingers 36' are then retracted to the right, away from hooks 18b as the transverse motion of the cross slide 24 and tube 28 to the right commences, to continue the payoff of the Y filament, as illustrated further by the arrow 52' in FIG. 16.

Again, during the period that fingers 36' are adjacent hooks 18b and during the "snap on" of the Y filament 16 over the three left hooks 18b on the left side panel 20, the cam actuated mechanism shown in FIG. 14, and described hereinafter, is actuated to cause the cross slide 24 carrying the payoff tube 28, arm 34 and fingers 36' to move forward longitudinally in the same direction and at the same velocity as the side panels 20, for the purpose noted above.

Figure 8:
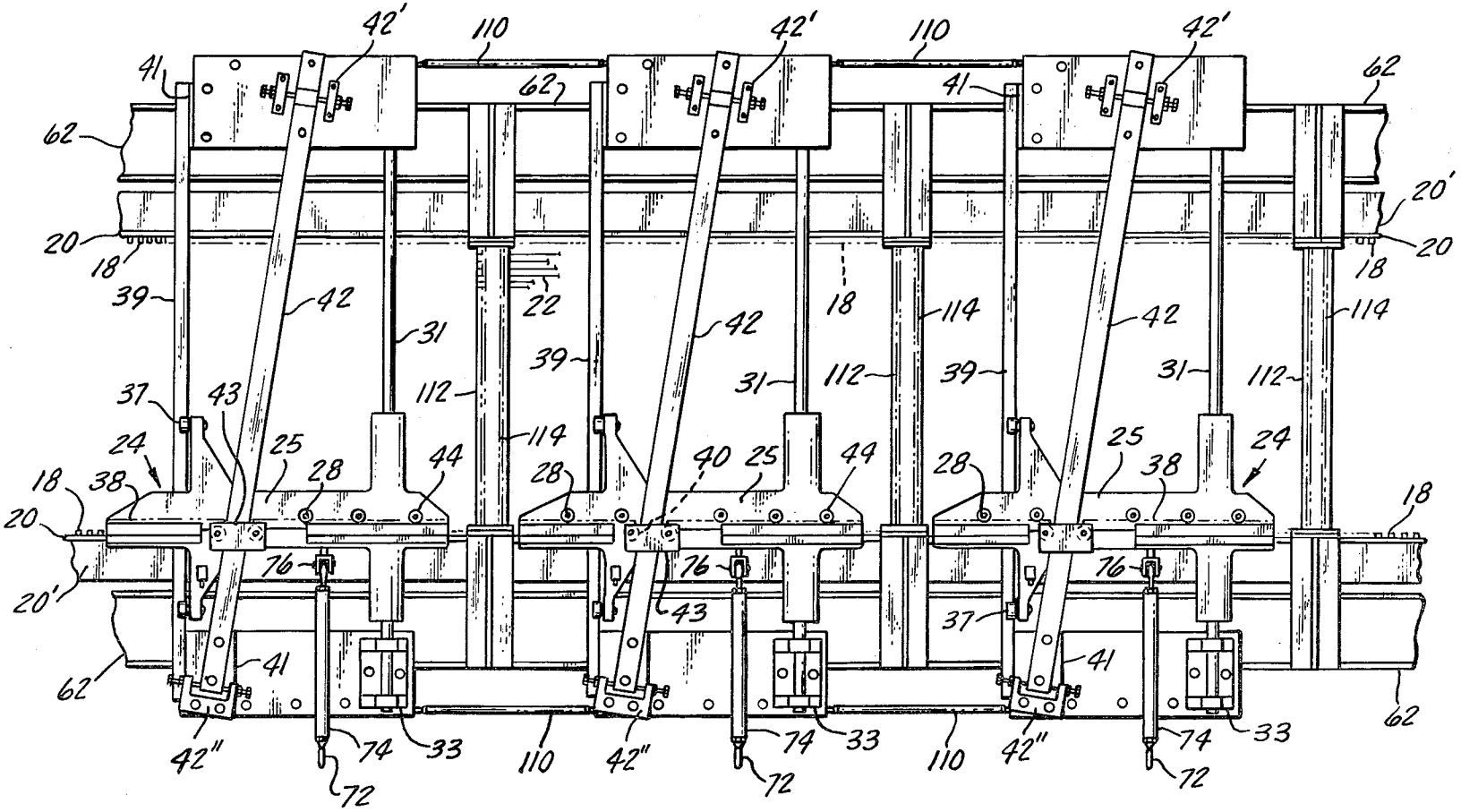
FIG. 8 is a plan view of the machine, showing the Y traverse mechanisms at a plurality of Y payoff stations, including the slide mechanism and associated cam and rack and pinion elements of each Y transverse mechanism.
Figure 12:
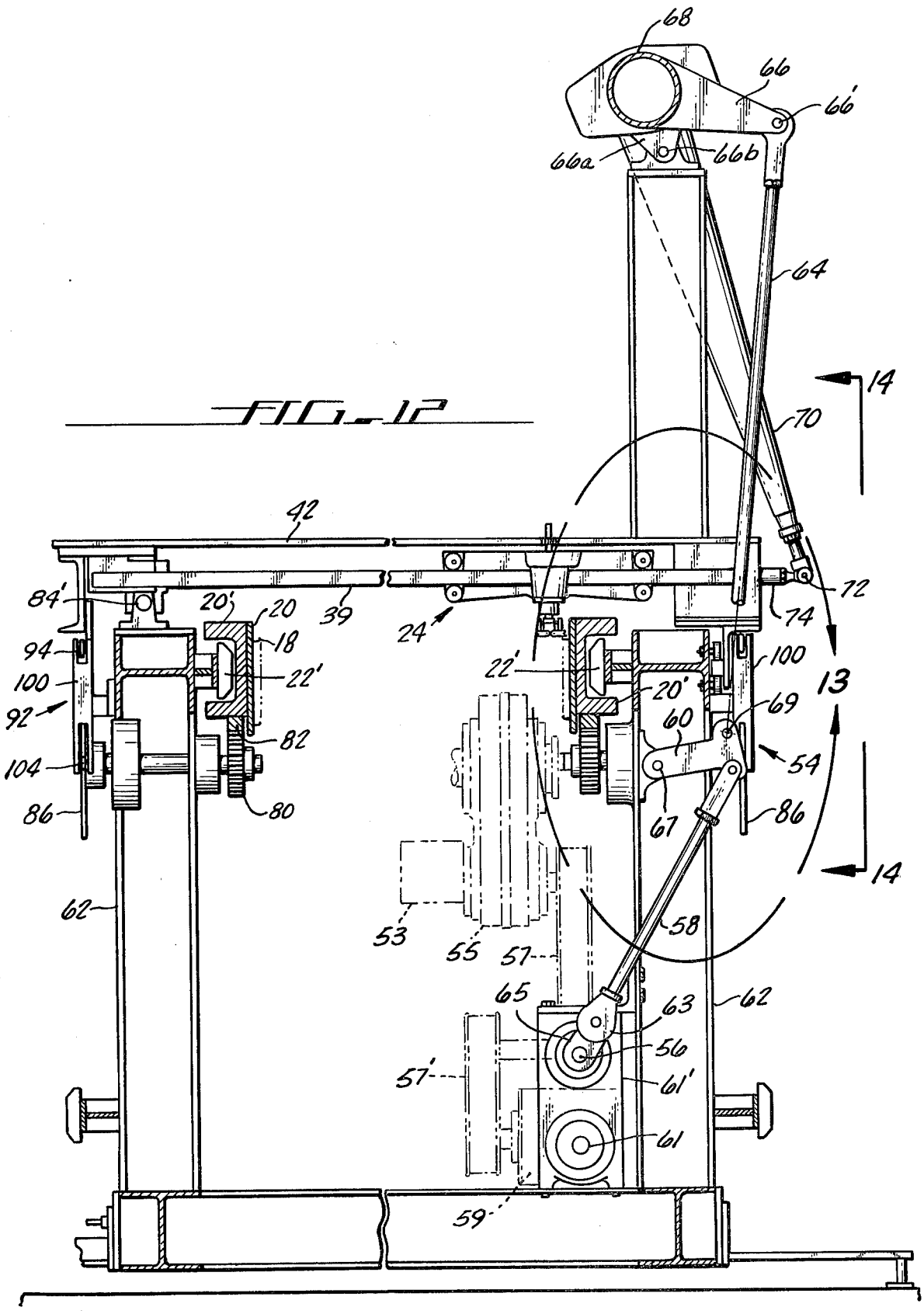
FIG. 12 is an elevational end view of the machine, showing the linkage mechanisms for activating and driving the transverse cross slide and the Y payoff tube thereon between the side panels of the machine.
Figure 12A:
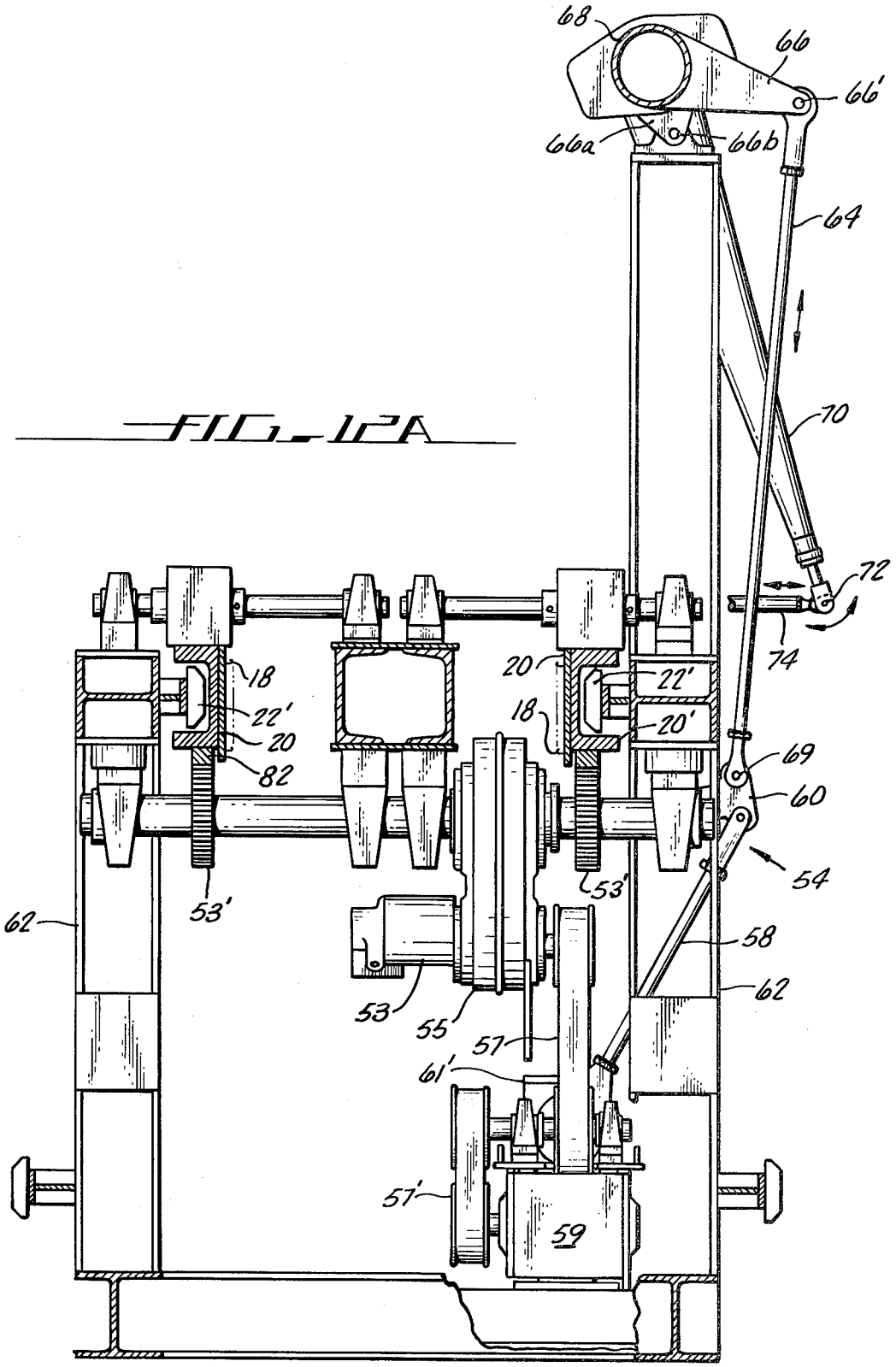
FIG. 12A is an elevational end view of the machine, similar to FIG. 12, showing in detail the driving mechanisms of the machine.
Figure 13:
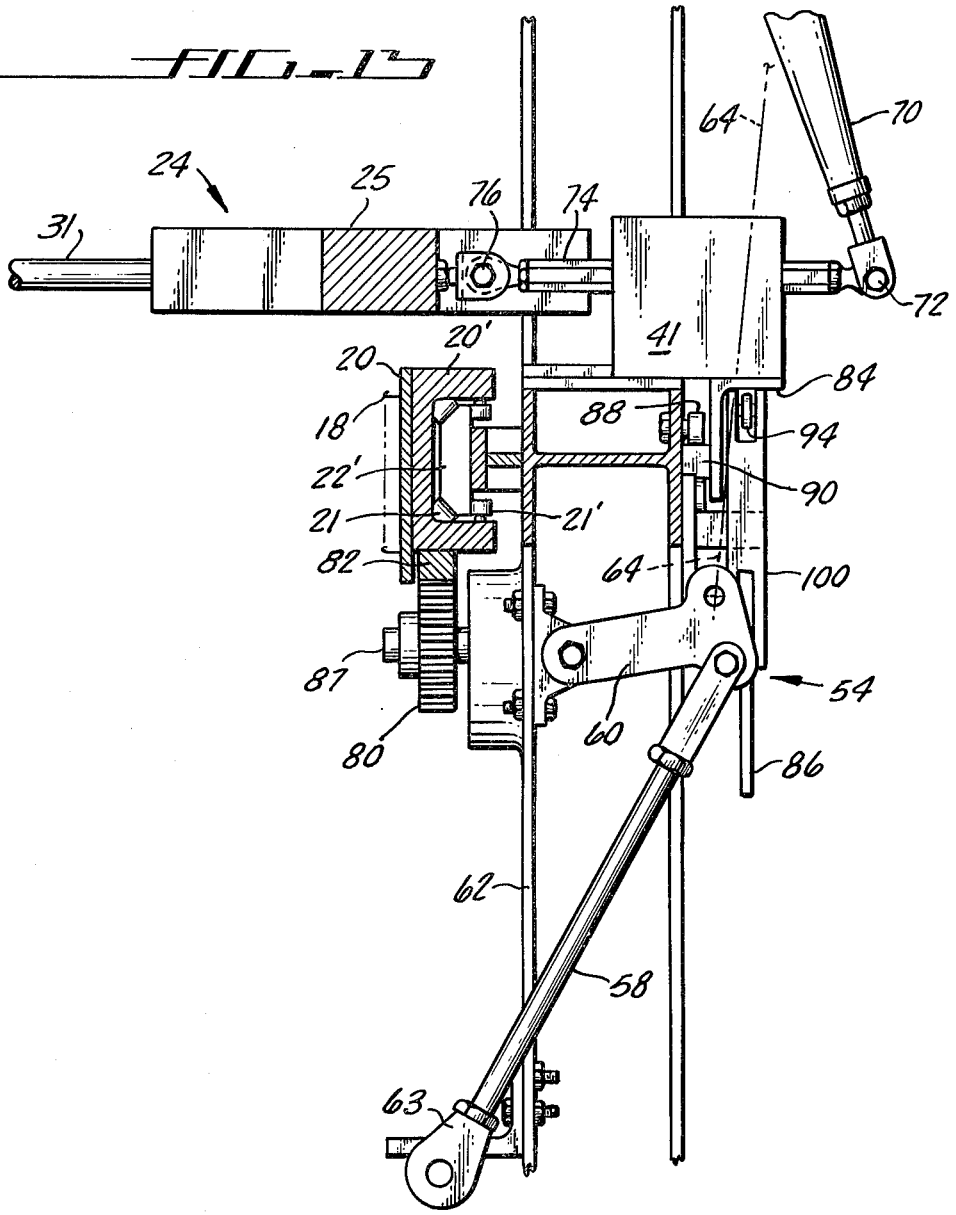
FIG. 13 is an elevational detail of the linkage mechanism shown in FIG. 12, taken on the circular arrows 13 in FIG. 12.

The Y traversing mechanism or transverse cross slide 24 is actuated by a rotary hydraulic motor 53 which through the fully adjustable linkage mechanism indicated at 54 in FIGS. 12, 12A and 13, imparts a simple harmonic motion to the cross slide 24 so that its transverse velocity is zero as the Y filament 16 is snapped over the hooks 18. The linkage mechanism 54 is driven from the main motor 53, the shaft of which is linked through gear reducers 55, timing belts 57 and 57', and gear reducer 59 to a torque tube 61, arranged to drive a gear reducer 61' having a shaft 56 and crank arm 65, which actuates the linkage mechanism 54. The linkage mechanism 54 is comprised of a link 58, the lower end 63 of which is mounted for rotation on crank arm 65 connected to the shaft of gear reducer 61'. The upper end of link 58 is pivotally connected to an arm 60 in turn pivotally connected at 67 to the machine frame 62. Pivotally connected at 69 to the arm 60 is an elongated link 64 in turn pivotally connected at 66' to one end of the rocker arm 66. The other end of rocker arm 66 is mounted on a torque tube 68 on which there is also mounted an arm 66a which is pin connected at 66b to frame 62, and on which there is also mounted a depending arm 70. Actuation of rocker arm 66 by link 64 imparts a rocking motion to elongated arm 70 through torque tube 68. The lower end of arm 70 is pivotally connected by a swivel joint 72 to a link 74 which is connected at its opposite end by a swivel joint 76 to plate 25 of the cross slide 24 (FIG. 9). Where a plurality of Y traverse mechanisms or cross slides 24 are employed, at predetermined spaced intervals slong the longitudinal length of the machine, as seen in FIG. 8, all of such cross slides 24 are actuated for synchronous transverse motion between the side panels 20, by means of the linkage mechanism 54 connected to each cross slide and actuated from the main drive motor 53, the driving arm 70 of each such linkage mechanism 54 being connected to torque tube 68.

The members of the linkage mechanism 54 described above are adjusted so as to control the transverse motion of the link 74 to drive the Y slide member 24 from one side panel 20 to the opposite side panel 20 and back. At the extreme end of each transverse motion of the link 74, the slide member 24 is at a position adjacent one of the panels 20 so that the fingers 36 or 36' are at the locations, e.g shown in FIGS. 3 and 4, for snapping the Y filament 16 onto the hooks **18*a* on one side panel 20 or the hooks 18*b* on the opposite side panel 20**.

Referring to FIGS. 10, 12 and 13, the side panels 20 are maintained in uniform longitudinal motion by means of suitable linkage to the motor 53. More specifically, referring to FIG. 12A, the motor 53 which drives the linkage mechanism 54 also drives the side panels 20 in the longitudinal direction through the gear reducers 55 to which are attached pinions 53' which engage gear racks 82. Referring also to FIGS. 2 and 10, gear racks 82 are directly attached by bolts (not shown) to the lower surface of mounting frames 20' on which the side panels 20 are mounted. The mounting frames 20' contains cam follower bearings 21 and rollers 21' which in turn ride on rails 22' attached to machine frame 62.

The timing of the controlled transverse motion of the Y traversing mechanism 24 relative to the movement of the side panels 20 is coordinated and synchronized, since as described above, the Y traversing mechanism and the side panels are both driven through mechanical linkages and gears from the main motor 53.

Figure 16:
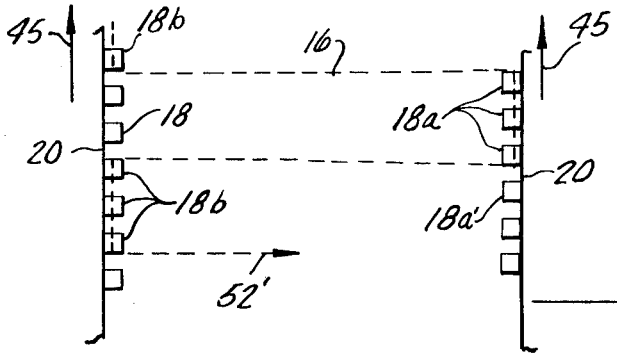
FIG. 16 is a plan view schematically illustrating the "figure 8" payoff path of a Y filament.

When the width of the scrim cloth being fabricated is relatively great compared to the spacing or pitch of the Y filaments, it is apparent that the maximum velocity of the cross slide 24 will be high relative to the constant forward velocity of the side panels 20. To reduce the maximum reciprocal transverse motion of the Y traverse mechanism 24 and the Y payoff acceleration and deceleration, and to permit some Y filaments to be above the X filaments, and some Y filaments to be below the X filaments in a weave-like pattern, as described more fully below, Y filaments preferably are payed off from a set or plurality of hooks such as the three hooks **18*a*, as seen in FIG. 16, to the opposite set of hooks such as the three hooks 18*b*, and past a number of the hooks 18*a'* on the opposite side panel 20 before the return pass is made. Thus, the pattern of a single Y filament payoff path is as illustrated in FIG. 16**.

As previously noted, in order to increase the time that the Y payoff tube 28 and the offset arm 34 and fingers 36 and 36' thereon are in close proximity to the hooks 18 of panels 20, and to thereby minimize the chance of interference between the fingers and the hooks during the fraction of time that the Y filaments are snapped over the hooks, as shown in FIGS. 2, 10, 13 and 14, the Y traverse mechanism 24 is mounted on longitudinal slides 84 and 84' on opposite sides of the machine adjacent opposite side panels 20. Such slides 84 and 84' are each mounted for longitudinal movement at the same velocity as the side panels 20 during the short period that the Y filaments are snapped over the hooks as described above and illustrated in FIGS. 3 and 4. Longitudinal reciprocating movement of the slide 84 is imparted by the rise and fall of the lobes on a cam 86 which is actuated by a shaft 87 mounted on the machine frame 62, and the pinion gear 80, which in turn is driven from rack 82 attached to each longitudinally moveable side panel 20.

The longitudinal slide 84, viewing FIG. 14, is mounted for longitudinal motion on rollers 88 mounted on frame 62, which roll on a plate 90 fixed to slide 84. Reciprocal longitudinal motion is imparted to the slide 84 is response to rotation of cam 86 by means of a pivotally mounted linkage 92, one adjustable arm 94 of which is pivotally connected at 96 to the rear of the slide 84. Arm 94 is also pivotally mounted at its outer end at 98 to a second arm 100 of the linkage 92, arm 100 being in turn pivotally mounted at 102 intermediate its ends on the machine frame 62. The lower end of arm 100 carries a guide roller or cam follower 104 in contact with the periphery of cam 86.

The guide roller 104 is maintained in contact with the cam surface by means of a spring 106 connected at one end to a fixed bracket 108 attached to machine frame 62, and at its opposite end is connected to the rear of slide 84. The spring 106 is biased in a direction urging the slide 84 longitudinally to the left in FIG. 14, thus maintaining guide roller 104 in contact with the periphery of cam 86, through the pivotal linkage 92.

As best seen in FIGS. 10, 12 and 14, the same structure for longitudinal motion of the Y slide members 24, including cam 86 and the associated elements including cam roller 104, the adjustable linkage mechanism 92 and the associated driving pinion 80 and rack 82 mounted on side panel 20, are positioned on directly opposite sides of the machine adjacent panels 20. Thus, slide 84' on the left in FIG. 10 carries the same structure which supports slide member 24 for longitudinal motion as in the case of slide 84 on the right.

As the side side panels 20 advance to the right, viewing FIG. 14, the gear rack 82 on each side panel 20 turns the pinion gear 80, causing clockwise rotation of cam 86, and as the roller 104 moves to the high spot **86*a* of the cam, the cam is so designed that slide 84 is thus caused to advance in the same longitudinal direction, that is, to the right, as the side panels 20 and at the same velocity. Accordingly, there is no relative longitudinal movement during this period between the Y traverse mechanism 24 and the payoff tubes 28 thereon, with respect to the side panels during snap-on of the Y fiber or filament over the hooks on the side panel 20, as seen in FIGS. 3 and 4, and as described above. As the cam 86 continues to rotate clockwise, the roller 104 moves to the low portion 86*b* of cam 86, as seen in FIG. 14, causing the spring 106 to quickly retract the slide 84 and the Y mechanism 24 carried thereon to the left, thus returning the Y traverse mechanism 24 to its original longitudinal position or station for the start of the next transverse motion of the Y traverse slide 24**.

Limited reciprocal longitudinal motion of the Y cross slide 24 is effected with respect to the linkage mechanism 54 which imparts transverse motion to the cross slide 24, through the swivel joints 72 and 76, as shown in FIG. 13.

A plurality of Y traverse mechanisms 24 and associated payoff tubes 28, and fingers 36 and 36' are positioned at predetermined spaced locations along the longitudinal length of the machine, as seen in FIG. 8, and such traverse slides 24 are each mounted as described above for synchronous transverse motion between side panels 20 and for synchronous controlled ongitudinal reciprocating motion. The last mentioned synchronous longitudinal motion is accomplished by interconnecting adjacent Y traverse mechanisms 24 mounted on slides 84 and 84' with adjustable linkages 110, as best seen in FIG. 14.

Figure 17:
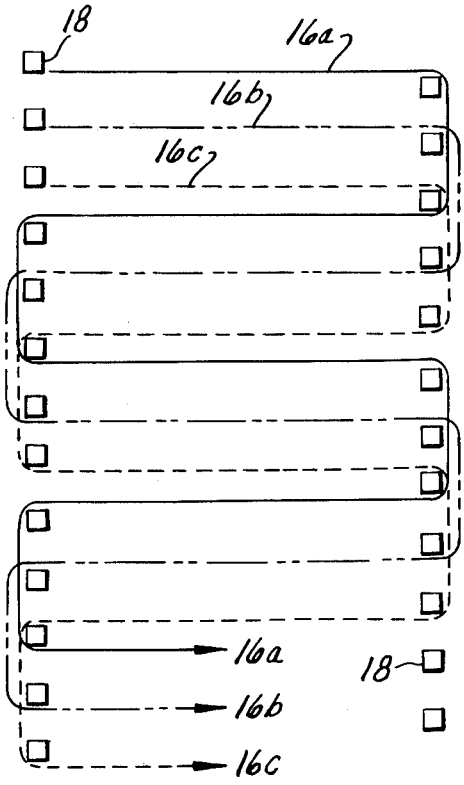
FIG. 17 is a plan view schematically illustrating the Y filament payoff pattern using three Y payoff tubes operating simultaneously.

As previously noted and shown in FIG. 8, a plurality of Y slides 24 each carrying a plurality of vertical Y payoff tubes 28 are spaced the proper distance apart along the machine, and by way of illustration, using three Y payoff tubes spaced the proper distance apart on each cross slide 24 and operating simultaneously, the Y filament pattern would appear as illustrated in FIG. 17, showing a plan view of the three Y filaments **16*a*, 16*b* and 16*c* alternately strung between the opposite hooks 18 on the opposite side panels 20**.

Figure 17A:
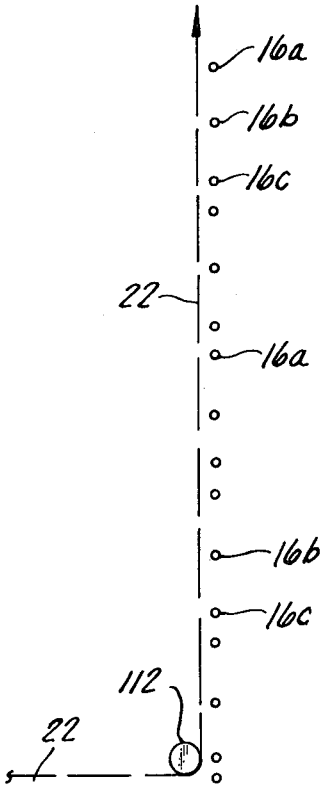
FIG. 17A is a side view schematically illustrating the paying off of a band of X (longitudinal) filaments above the Y filaments in FIG. 17.

If the X or longitudinal filaments 22(see FIG. 1A) are now introduced by paying off a spaced band of these filaments above the three Y filaments **16*a*, 16*b* and 16*c*, and allowing the introduced X filaments to rest on and be carried by the Y filaments, the pattern would appear as illustrated in FIG. 17A**.

Figure 19:
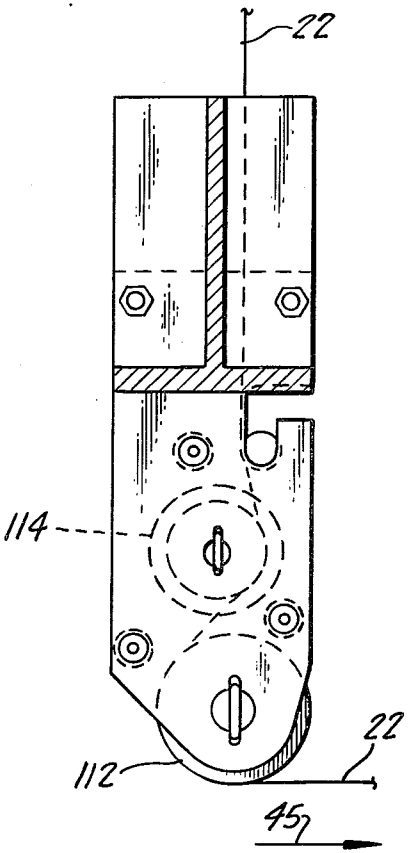
FIG. 19 is a sectional view taken on line 19—19 of FIG. 18.
Figure 18:
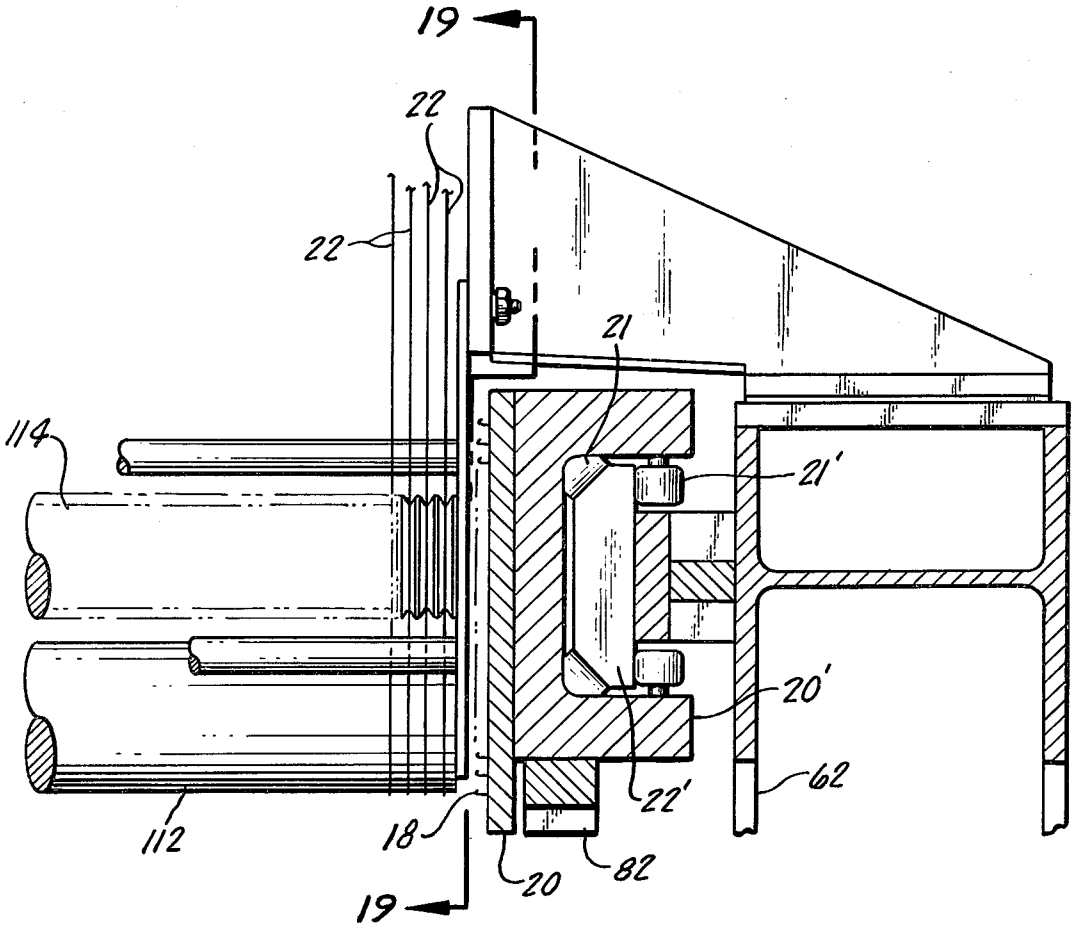
FIG. 18 is an enlarged elevational detail view, partly in section, showing the guide rollers for paying off the longitudinal X filaments.

Referring to FIGS. 8, 18 and 19, the mechanism for paying off the band of X fibers 22 in a continuous manner, comprises a guide roller 112 transversely mounted across the machine on the machine frame 62, and a transversely mounted guide roller 114 also mounted on the machine frame above roller 112, the rollers 112 and 114 extending between the side panels 20, closely adjacent to the side panels and the hooks 18 positioned thereon.

Figure 20:
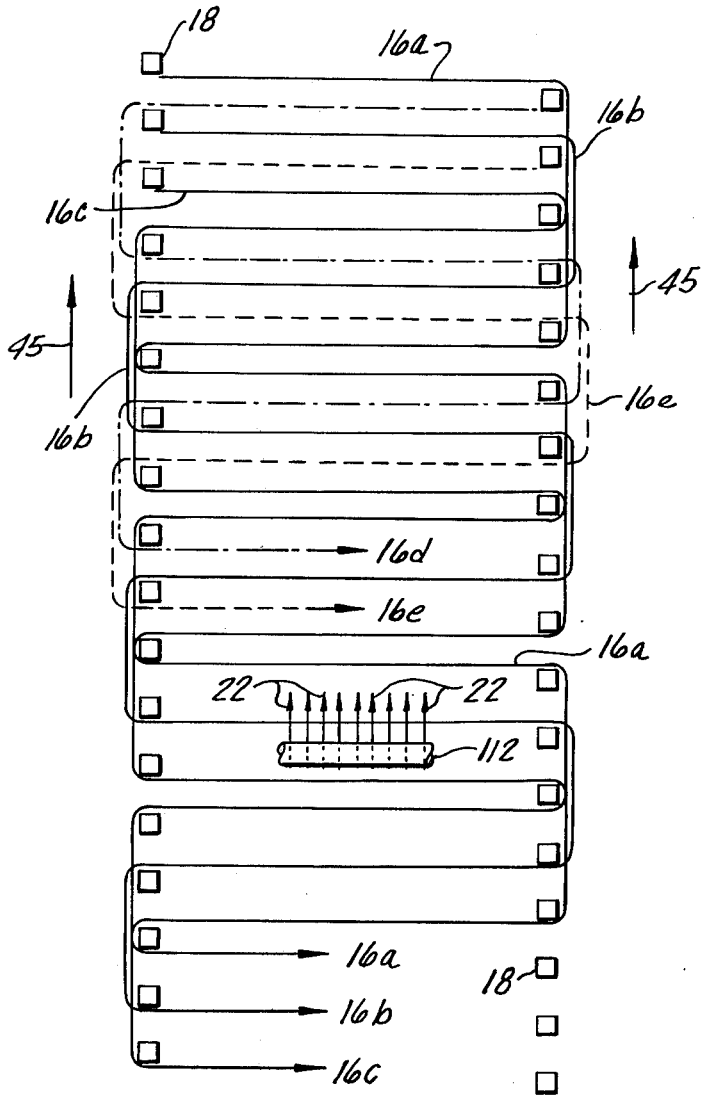
FIG. 20 is a plan view showing schematically the addition of two more Y payoff tubes operating simultaneously with the three Y payoff tubes illustrated in FIG. 17, but located in the conveyer line after the X filaments are payed off, to produce Y filaments both over and under the X filaments.
Figure 20A:
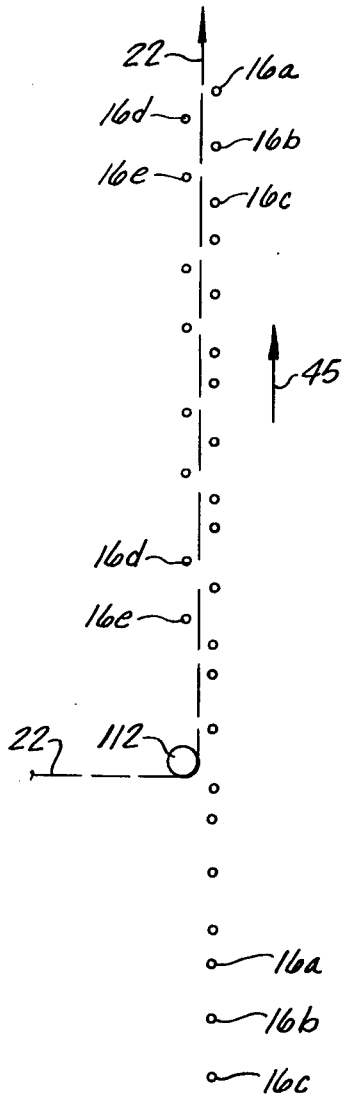
FIG. 20A is a side view of the schematic illustration shown in FIG. 20.

Referring now to FIG. 20, if to the system illustrated in FIGS. 17 and 17A, there are now added two more Y payoff tubes to operate simultaneously with the three Y payoff tubes illustrated in FIGS. 17 and 17A, but located in the longitudinal line after the band of X filaments 22 have been payed off, the pattern of the filaments is as shown in FIGS. 20 and 20A, with the two additional Y transverse filaments **16*d* and 16*e* noted in position above the X filaments 22, while the previously strung Y filaments 16*a*, 16*b* and 16*c* are below the X filaments 22. A continuous uniformly spaced scrim cloth having continuous X filaments and a 3-under-2-over Y filament pattern is thus produced, as illustrated in FIG. 21. This over-under pattern can be varied by changing the number of Y payoff arms on each cross slide 24, the number of hooks 18 skipped, and the location and manner of introduction of the X filaments. Alternative X-Y scrim cloth configurations are shown in FIGS. 22 and 23. In FIG. 22 the scrim cloth has continuous X filaments and a 1-under-4-over Y filament pattern, the scrim cloth of FIG. 23 having continuous X filaments and an alternate 1-under-1**-over Y filament pattern. A variation of this arrangement could also be provided to form a diagonal or diamond shaped pattern if desired. Thus, numerous pattern variations are possible.

FIG. 24 shows one cross slide member 24 of the plurality of slides 24 shown in FIG. 8, and containing five Y payoff tubes 28 and associated offset arms 34 and fingers 36 and 36', and showing a portion of the transverse motion actuating mechanism and of the longitudinal motion actuating mechanism, described above.

Several layers of cloth can be fabricated sequentially, as illustrated in FIGS. 1 and 1A, and spaced a discrete distance apart by having several rows of hooks 18 attached to the side panels 20 and by having Y payoff tubes 28 of the correct corresponding lengths for each layer produced. Registration of the X-Y squares formed in the scrim cloth relative to each other as illustrated in FIGS. 1 and 21 to 23, is precise as determined by the location of the hooks on the machine side panels and the alignment of the X guide rollers 112 and 114.

Either the X or Y filaments can be impregnated with resin or wet wound, or the cross-over points can be coated or sprayed with suitable adhesive to lock the cross-over points of the X and Y filaments or to stiffen the scrim cloth, if desired.

In any case, the net result is the production of a uniformly spaced, retained X–Y array in the form of layers, and into which vertical Z fibers can be introduced into the X–Y squares, and foam then added to the resulting array to produce a filamentary reinforced foam product.

Since the introduction of vertical Z fibers into the layers of X–Y scrim cloth produced according to the present invention, and the introduction of foam into the resulting X–Y–Z array form no part of the present invention, no further description of these techniques is set forth herein.

While certain exemplary embodiments of this invention have been described above and shown in the accompanying drawings, it is to be understood that such embodiments are merely illustrative of, and not restrictive on, the broad invention and that we do not desire to be limited in our invention to the specific dimensions, constructions or arrangements shown and described since various other obvious modifications may occur to persons having ordinary skill in the art.

What is claimed is:

1. In apparatus for fabricating open weave scrim cloth consisting of uniformly spaced longitudinal or X filaments, and transverse or Y filaments, the combination comprising transversely spaced parallel longitudinally extending moveable supports, hooks mounted on said supports in oppositely facing relation, and a Y filament or fiber payoff mechanism positioned between said moveable supports, said Y payoff mechanism including fiber dispensing means, support means for said fiber dispensing means, said fiber dispensing means being mounted on said support means, means mounting said support means and said fiber dispensing means for transverse motion between the oppositely facing hooks on said longitudinally extending supports, means for rotating said fiber dispensing means a predetermined amount during transverse motion of said fiber dispensing means from adjacent the hooks on one said longitudinally extending support to adjacent the hooks on the opposite said longitudinally extending support, and fiber support means carried on said fiber dispensing means, to receive a fiber from said fiber dispensing means during rotation and transverse motion thereof between said longitudinally extending supports, and to snap said filament over a hook or hooks on one of said longitudinally extending supports when said fiber dispensing means and said fiber support means are disposed adjacent the hooks on said one of said longitudinally extending supports.

2. In apparatus for fabricating open weave scrim cloth consisting of uniformly spaced longitudinal or X filaments or fibers, and transverse or Y filaments or fibers, the combination comprising transversely spaced parallel longitudinally extending moveable supports, hooks mounted on said supports in oppositely facing relation, and a Y filament or fiber payoff mechanism positioned between said moveable supports, said Y payoff mechanism including at least one vertically disposed fiber dispensing tube element, tube support means, said at least one tube element being mounted on said tube support means, means for limited transverse motion of said tube support means and said tube element mounted thereon between the oppositely facing hooks on said longitudinally extending supports, means for rotating said at least one tube element a predetermined amount during transverse motion of said tube element from adjacent the hooks on one said longitudinally extending support, to adjacent the hooks on the opposite said longitudinally extending support, and finger means carried on said fiber dispensing tube element adjacent the lower end thereof, said finger means constructed to receive a fiber from the lower end of said fiber dispensing tube element during rotation and transverse motion thereof between said longitudinally extending supports, and to snap said filament over a hook or hooks on one of said longitudinally extending supports when said tube element and said finger means are disposed adjacent the hooks on said one of said longitudinally extending supports.

3. Apparatus as defined in claim 2, including an offset arm carried on the lower end of said tube element, said finger means being mounted on said offset arm for clockwise or counterclockwise rotation with said tube element.

4. Apparatus as defined in claim 2, said means for rotating said tube element including rack and pinion means associated with said tube element.

5. Apparatus as defined in claim 4, said rack and pinion means including a pinion mounted on said tube, a rack engaging said pinion, and means for moving said rack longitudinally a controlled amount during transverse movement of said tube support means, said tube element and said rack, from adjacent said hooks on one of said longitudinally extending supports to adjacent the oppositely facing hooks on the opposite longitudinally extending support.

6. Apparatus as defined in claim 5, said tube support means including a transverse slide member, said tube element suspended from said slide member, said means for moving said rack longitudinally including a fixed cam member, means mounting said cam member diagonally across said longitudinally extending moveable supports at an angle to the transverse axis, a slideable connection between said rack and said cam member, and means maintaining said pinion in engagement with said rack during transverse movement of said slide member and said tube element, between said longitudinally extending supports.

7. Apparatus as defined in claim 6, said longitudinally extending supports being longitudinally moveable side members, and including means for longitudinally moving said slide member, said tube element and said finger means mounted thereon, forward a controlled distance at the same longitudinal speed as said moveable side members, when said tube element and finger means are disposed adjacent the hooks on one of said side members and during snap-on of said filament on a hook or hooks.

8. Apparatus as defined in claim 7, including means for retracting said slide member longitudinally said controlled distance after said finger means have snapped said filament on said hooks and prior to further transverse movement of said slide member.

9. Apparatus as defined in claim 8, said means for longitudinally moving said slide member a controlled distance and said means for retracting said slide member a controlled distance comprising a cam, rack means mounted on said longitudinally moveable side members, pinion means engaged with said last mentioned rack means and driving said cam, in response to longitudinal movement of said side members, a linkage mechanism connected between said cam means and said slide member for longitudinally moving said slide member in response to actuation of said cam, and spring means connected to said slide member for retracting said slide member after said controlled forward longitudinal movement thereof.

10. Apparatus as defined in claim 8, including means for contacting and downwardly pivoting said finger means when said tube element and said finger means thereon are disposed adjacent the hooks on one of said side members, to facilitate snap-on of said filament on said hooks, and for retracting said pivoting means away from said finger means after snap-on of said filament on said hooks.

11. Apparatus as defined in claim 8, including means for extending a plurality of X fibers in a longitudinal direction between said moveable supports and over the transverse Y fibers strung between oppositely facing hooks on said longitudinally extending moveable supports.

12. Apparatus as defined in claim 2, said longitudinally extending supports being longitudinally moveable side members, and including means for longitudinally moving said tube support means, said tube element and said finger means mounted thereon, forward a controlled distance at the same longitudinal speed as said moveable side members, when said tube element and finger means are disposed adjacent the hooks on one of said side members and during snap-on of said filament on a hook or hooks.

13. Apparatus as defined in claim 12, including means for retracting said tube support means longitudinally said controlled distance after said finger means have snapped said filament on said hooks and prior to further transverse movement of said tube support means.

14. Apparatus as defined in claim 13, said means for longitudinally moving said tube support means a controlled distance and said means for retracting said tube support means a controlled distance comprising cam means actuated by longitudinal movement of said longitudinally extending moveable supports, linkage means for longitudinally moving said tube support means in response to actuation of said cam means, and spring means connected to said tube support means for retracting same after said controlled forward longitudinal movement of said tube support means.

15. Apparatus ad defined in claim 2, including means for pivoting said finger means when said tube element and said finger means thereon are disposed adjacent the hooks on one of said longitudinally extending supports, to facilitate snap-on of said filaments on said hooks.

16. Apparatus as defined in claim 2, including means for extending a plurality of X fibers in a longitudinal direction over the transverse Y fibers strung between oppositely facing hooks on said longitudinally extending moveable supports.

17. Apparatus as defined in claim 2, including a plurality of said Y filament payoff mechanisms positioned sequentially in a longitudinal direction between said moveable supports, and a plurality of X payoff mechanisms spaced longitudinally between said moveable supports and alternating with said Y payoff mechanisms, for continuously extending a plurality of continuous layers of X fibers in a longitudinal direction over the respective layers of transverse Y fibers, and forming a plurality of layers of X-Y scrim cloth.

18. Apparatus as defined in claim 17, each of said Y filament payoff mechanisms including a plurality of said tube elements, and means for rotating all of said tube elements simultaneously a like predetermined amount during transverse motion of said tube elements from adjacent the hooks on one said longitudinally extending support, to adjacent the hooks on the opposite said longitudinally extending support.

19. Apparatus ad defined in claim 2, said means for transverse motion of said tube support means including linkage means connected to said tube support means and means for actuating said linkage means.

20. In apparatus for fabricating open-weave scrim cloth consisting of uniformly spaced longitudinal or X filaments and transverse or Y filaments, the combination comprising a pair of spaced parallel longitudinally extending side panels, hooks mounted on said side panels in oppositely facing relation, and a Y filament or fiber payoff mechanism positioned between said moveable supports, said Y payoff mechanism including at least one vertically disposed fiber dispensing tube, a cross slide member mounter for transverse motion between the oppositely facing hooks on said side panels, means connecting said at least one tube in vertical depending position on said slide member, an offset arm mounted on the lower end of said payoff tube, fingers connected to said arm for receiving a Y filament passing through said tube and fed to said fingers, cam means connected to said at least one payoff tube for rotation of said tube a predetermined amount during transverse motion of said tube from adjacent the hooks on one of said side members to adjacent the hooks on the opposite side member, said Y filament being positioned on said fingers during said rotation of said tube, said fingers carrying said Y filament being in position to snap said filament on the hooks on the respective side panels when said cross slide member reaches the respective opposite remote ends of its transverse motion.

21. Apparatus as defined in claim 20, including a plurality of said payoff tubes mounted in depending vertical position on said slide member, an offset arm mounted on the lower end of each of said payoff tubes, fingers connected to each of said arms for receiving a Y filament passing through its associated tube and fed to said fingers, said cam means connected to each of said payoff tubes for simultaneous rotation of all of said tubes the same predetermined amount during said transverse motion of said tubes from adjacent the hooks on one of said side members to adjacent the hooks on the opposite side member.

22. Apparatus as defined in claim 20, said fingers including notches for receiving and positioning said Y filament on said fingers during said rotation of said tube, said means for rotating said tube comprising a fixed cam member, means mounting said cam member diagonally across said side panels at an angle to the transverse axis, a longitudinally moveable rack, a pinion mounted on said tube, said rack engaging said pinion, a slideable connection between said rack and said diagonal cam, and means maintaining said pinion in engagement with said rack during transverse motion of said slide member and said tube between said moveable side panels, and during longitudinal motion of said rack, which causes rotation of said tube and fingers thereon.

23. Apparatus as defined in claim 22, including means for longitudinally moving said cross slide member and said tube and said fingers mounted thereon, forward a controlled distance at the same longitudinal speed as said moveable side panels when said payoff tube and fingers thereon are disposed adjacent the hooks on one of said side panels during snap-on of said filament on said hooks, and means for retracting said cross slide member and said tube longitudinally said controlled longitudinal distance after said fingers have snapped said filament on said hooks and prior to further transverse movement of said tube, said means for imparting said longitudinal movement to said cross slide member and said means for retracting said cross slide member including a second rack mounted on a longitudinally moveable side panel, a second pinion engaging said last mentioned rack, a second cam, said second pinion connected to said last mentioned cam for rotating same in response to longitudinal movement of said side panel, a cam follower on said last mentioned cam, pivotally mounted linkage means connected at one end to said cam follower and at the opposite end to said slide member, and a spring connected to said slide member for retracting said slide member following longitudinal movement thereof to its controlled limit of longitudinal movement.

24. Apparatus as defined in claim 22, including means for longitudinally moving said cross slide member and said tube and said fingers mounted thereon, forward a controlled distance at the same longitudinal speed as said moveable side panels when said payoff tube and fingers thereon are disposed adjacent the hooks on one of said side panels during snap-on of said filament on said hooks, and means for retracting said cross slide member and said tube longitudinally said controlled longitudinal distance after said fingers have snapped said filament on said hooks and prior to further transverse movement of said tube, said means for imparting said longitudinal movement to said cross slide member and said means for retracting said cross slide member including means adjacent each of said longitudinally moveable side panels, such last mentioned means including a second rack mounted on said adjacent side panel, a second pinion engaging said last mentioned rack, a second cam, said second pinion connected to said last mentioned cam for rotating same in response to longitudinal movement of said side panel, a cam follower on said last mentioned cam, pivotally mounted linkage means connected at one end to said cam follower and at the opposite end to said slide member, and a spring connected to said slide member for retracting said slide member following longitudinal movement thereof to its controlled limit of longitudinal movement.

25. Apparatus as defined in claim 22, including two sets of fingers, means mounting said two sets of fingers in opposite relation on said offset arm, one set of said fingers being positioned adjacent the hooks on one of said side panels and the other set of said fingers being positioned adjacent the hooks on the other of said side panels upon rotation of said tube during said transverse motion of said tube, when said cross slide member reaches the respective opposite remote ends of its transverse motion.

26. Apparatus as defined in claim 20, including means mounting said fingers for pivotal movement on said offset arm, means for contacting and pivoting said fingers downwardly when said fingers are disposed adjacent the hooks on one of said side panels, to facilitate placement of the filament carried on said fingers onto said hooks, and means for retracting said fingers to cause pivotal movement of said fingers upwardly to normal horizontal position after said Y filament has been engaged by said hooks.

27. Apparatus as defined in claim 20, including a plurality of said Y filament payoff mechanisms spaced longitudinally at predetermined intervals along and between said side panels, and a plurality of means for extending X fibers longitudinally between said side panels, said means for extending said longitudinal X fibers being spaced longitudinally between adjacent Y filament payoff mechanisms, and forming a plurality of vertically spaced layers of X–Y scrim cloth.

28. In a process for continuously fabricating open-weave scrim cloth consisting of uniformly spaced longitudinal or X filaments, and transverse or Y filaments, the improvement which comprises traversing said Y filaments between oppositely facing hooks attached to elongated spaced parallel longitudinally moving side panels, paying off each Y filament from a filament dispensing tube transversely moving between said side panels, passing said filament to a filament support device mounted adjacent to said dispensing tube for transverse motion therewith, rotating said filament support device to capture a Y filament thereon from said filament dispensing tube and to position said Y filament adjacent a hook or hooks on one of said side panels when the dispensing tube and filament support device are positioned adjacent the hooks on said one of said side panels, and snapping said Y filament from said filament support device on said hook or hooks.

29. A process as defined in claim 28, including moving said filament dispensing tube and said filament support associated with said tube, longitudinally forward for a limited distance at the same longitudinal speed as the longitudinally moving side panels when the filament dispensing tube and filament support device are positioned adjacent the hooks on a side panel, said snapping of the Y filament on the hook or hooks on one of said side panels taking place during said limited longitudinal motion of said filament dispensing tube and said filament support device, and retracting said filament dispensing tube and filament support device longitudinally said limited distance after the filament is snapped on said hook or hooks and prior to further transverse motion of said filament dispensing tube and said filament support device associated with said tube.

30. A process as defined in claim 29, including paying off bands of spaced X filaments longitudinally over said transverse Y filaments between said longitudinally moving side panels.

31. A process as defined in claim 30, including providing a plurality of transversely moving Y filament payoff stations positioned sequentially in a longitudinal direction between said side panels, and simultaneously stringing a plurality of said Y filaments between the oppositely facing hooks on said longitudinally moving side panels, and a plurality of X filament payoff stations spaced longitudinally between said moving side panels and between said Y filament payoff stations, and simultaneously extending a plurality of continuous layers of X fibers in a longitudinal direction over the respective layers of Y fibers, and forming a plurality of layers of X-Y scrim cloth.

32. A process as defined in claim 28, including paying off bands of spaced X filaments longitudinally over said transverse Y filaments between said longitudinally moving side panels.

33. A process as defined in claim 32, including providing a plurality of transversely moving Y filament payoff stations positioned sequentially in a longitudinal direction between said side panels, and simultaneously stringing a plurality of said Y filaments between the oppositely facing hooks on said longitudinally moving side panels, and a plurality of X filament payoff stations spaced longitudinally between said moving side panels and between said Y filament payoff stations, and simultaneously extending a plurality of continuous layers of X fibers in a longitudinal direction over the respective layers of Y fibers, and forming a plurality of layers of X-Y scrim cloth.

* * * * *